US010290272B2

(12) United States Patent
Yoshiga

(10) Patent No.: US 10,290,272 B2
(45) Date of Patent: May 14, 2019

(54) DISPLAY DEVICE CAPABLE OF REDUCING FLICKERS

(71) Applicant: InnoLux Corporation, Miao-Li County (TW)

(72) Inventor: Masahiro Yoshiga, Miao-Li County (TW)

(73) Assignee: InnoLux Corporation, Miao-Li County (TW)

( * ) Notice: Subject to any disclaimer, the term of this patent is extended or adjusted under 35 U.S.C. 154(b) by 0 days.

(21) Appl. No.: 15/687,555

(22) Filed: Aug. 28, 2017

(65) Prior Publication Data

US 2019/0066610 A1 Feb. 28, 2019

(51) Int. Cl.
*G09G 3/36* (2006.01)

(52) U.S. Cl.
CPC ..... *G09G 3/3614* (2013.01); *G09G 3/3618* (2013.01); *G09G 3/3648* (2013.01); *G09G 2300/0404* (2013.01); *G09G 2300/0426* (2013.01); *G09G 2300/0823* (2013.01); *G09G 2300/0852* (2013.01); *G09G 2310/0289* (2013.01); *G09G 2310/08* (2013.01); *G09G 2320/0247* (2013.01)

(58) Field of Classification Search
CPC ..... G02F 1/1343; G09G 3/36; G09G 3/30; G09G 5/00; G06F 3/038
See application file for complete search history.

(56) References Cited

U.S. PATENT DOCUMENTS

2007/0040785 A1* 2/2007 Edwards ..... G09G 3/3614 345/92
2009/0002582 A1* 1/2009 Sano ..... G09G 3/3618 349/38
2010/0177083 A1* 7/2010 Yamashita ..... G09G 3/20 345/211
2013/0033509 A1* 2/2013 Yamashita ..... G09G 3/2007 345/530
2013/0286001 A1* 10/2013 Nakano ..... G09G 3/3648 345/212

* cited by examiner

*Primary Examiner* — Pegeman Karimi
(74) *Attorney, Agent, or Firm* — Winston Hsu

(57) ABSTRACT

A pixel circuit includes a first capacitor, a second capacitor, a first transistor, a second transistor, and a third transistor. The first capacitor has a first terminal coupled to a common voltage line. The second capacitor has a first terminal coupled to a first control line. The first transistor has a first terminal coupled to a source line, a second terminal coupled to a second terminal of the first capacitor, and a control terminal coupled to a second terminal of the second capacitor. The second transistor has a first terminal coupled to the control terminal of the first transistor, and a control terminal coupled to a second control line. The third transistor has a first terminal coupled to a second terminal of the second transistor, a second terminal coupled to a third control line, and a control terminal coupled to the second terminal of the first transistor.

20 Claims, 20 Drawing Sheets

DISPLAY DEVICE CAPABLE OF REDUCING FLICKERS

BACKGROUND OF THE DISCLOSURE

1. Field of the Disclosure

The present disclosure relates to a display device, and more particularly to display device capable of improving display quality.

2. Description of the Prior Art

Display devices have been widely used in a variety of applications, such as smart phones, personal computers, and electronic book readers. However, according to usage scenarios of the applications, different types of display devices may be chosen. To generate a desired image, a display device usually arranges its pixels in an array, and the pixels are updated to receive the pixel voltages separately and sequentially according to the image data. Then the pixels will display different levels of brightness according to the pixel voltages received.

In some situations, the display device may display a still image. In this case, power is wasted if the pixels are updated with the same data. Therefore, the memory in pixel (MIP) circuits are usually used to store the pixel voltages of the image data so the pixels can be refreshed accordingly without repeated updating operations, reducing the power consumption. However in prior art, charges stored by the memory in pixel will dissipate after a long duration, the pixel voltages will drop, causing flickers when displaying images, and the display quality is poor.

SUMMARY OF THE DISCLOSURE

One embodiment of the present disclosure discloses a display device. The display device includes a pixel array, a source driver and a control driver.

The pixel array includes a source line, a common voltage line, a first control line, a second control line, a third control line, and a pixel circuit. The pixel circuit includes a first capacitor, a second capacitor, a first transistor, a second transistor, and a third transistor.

The first capacitor has a first terminal and a second terminal, wherein the first terminal of the first capacitor is coupled to the common voltage line. The second capacitor has a first terminal and a second terminal, the first terminal of the second capacitor is coupled to the first control line. The first transistor has a first terminal, a second terminal and a control terminal, wherein the first terminal of the first transistor is coupled to the source line, the second terminal of the first transistor is coupled to the second terminal of the first capacitor, and the control terminal of the first transistor is coupled to the second terminal of the second capacitor. The second transistor has a first terminal, a second terminal and a control terminal, wherein the first terminal of the second transistor is coupled to the control terminal of the first transistor, and the control terminal of the second transistor is coupled to one of the second control line. The third transistor has a first terminal, a second terminal and a control terminal, wherein the first terminal of the third transistor is coupled to the second terminal of the second transistor, the second terminal of the third transistor is coupled to the third control line, and the control terminal of the third transistor is coupled to the second terminal of the first transistor.

The source driver drives the source line. The control driver drives the first control line, the second control line, and the third control line.

Another embodiment of the present disclosure discloses a pixel circuit. The pixel circuit includes a first capacitor, a second capacitor, a first transistor, a second transistor, and a third transistor.

The first capacitor has a first terminal and a second terminal, wherein the first terminal of the first capacitor is coupled to the common voltage line. The second capacitor has a first terminal and a second terminal, the first terminal of the second capacitor is coupled to the first control line. The first transistor has a first terminal, a second terminal and a control terminal, wherein the first terminal of the first transistor is coupled to the source line, the second terminal of the first transistor is coupled to the second terminal of the first capacitor, and the control terminal of the first transistor is coupled to the second terminal of the second capacitor. The second transistor has a first terminal, a second terminal and a control terminal, wherein the first terminal of the second transistor is coupled to the control terminal of the first transistor, and the control terminal of the second transistor is coupled to one of the second control line. The third transistor has a first terminal, a second terminal and a control terminal, wherein the first terminal of the third transistor is coupled to the second terminal of the second transistor, the second terminal of the third transistor is coupled to the third control line, and the control terminal of the third transistor is coupled to the second terminal of the first transistor.

Another embodiment of the present disclosure discloses a display device. The display device includes a pixel array, a source driver and a control driver.

The pixel array includes a source line, a common voltage line, a first control line, a second control line, and a pixel circuit. The pixel circuit includes a first capacitor, a second capacitor, a first transistor, and a second transistor.

The first capacitor has a first terminal, and a second terminal, wherein the first terminal of the first capacitor is coupled to the common voltage line. The second capacitor has a first terminal, and a second terminal, wherein the first terminal of the second capacitor is coupled to the first control line. The first transistor has a first terminal, a second terminal, and a control terminal, wherein the first terminal of the first transistor is coupled to the source line, the second terminal of the first transistor is coupled to the second terminal of the first capacitor, and the control terminal of the first transistor is coupled to the second terminal of the second capacitor. The second transistor has a first terminal, a second terminal, and a control terminal, wherein the first terminal of the second transistor is coupled to the control terminal of the first transistor, the second terminal of the second transistor is coupled to the second terminal of the first capacitor, and the control terminal of the second transistor is coupled to the second control line.

The source driver can drive the source line, and the control driver can drive the first control line, the second control line.

These and other objectives of the present disclosure will no doubt become obvious to those of ordinary skill in the art after reading the following detailed description of the embodiment that is illustrated in the various figures and drawings.

DETAILED DESCRIPTION

Figure 1:
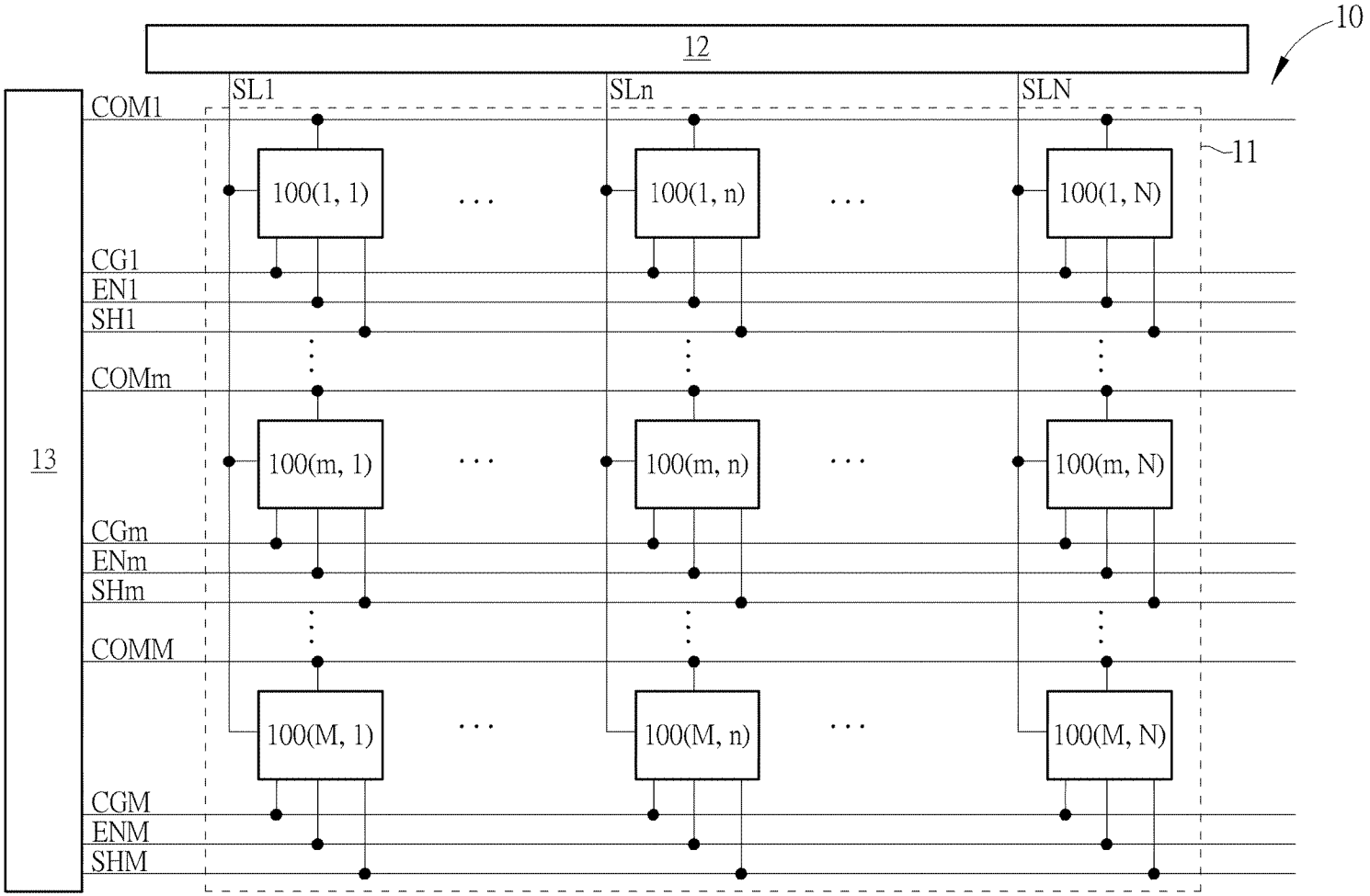
FIG. 1 shows a display device according to one embodiment of the present disclosure.

FIG. 1 shows a display device 10 according to one embodiment of the present disclosure. The display device 10 includes a pixel array 11, a source driver 12, and a control driver 13.

The pixel array 11 includes N source lines SL1 to SLN, M common voltage lines COM1 to COMM, M first control lines CG1 to CGM, M second control lines EN1 to ENM, M third control lines SH1 to SHM, and M×N pixel circuits 100(1,1) to 100(M,N) arranged in a matrix. M and N are integers greater than 1. Each of pixel circuits 100(1,1) to 100(M,N) is coupled to a corresponding source line, a corresponding common voltage line, a corresponding first control line, a corresponding second control line, and a corresponding third control line.

In FIG. 1, pixel circuits in the same row can be coupled to the same common voltage line, the same first control line, the same second control line, the same third control line, and different source lines.

For example, the pixel circuits 100(1,1) to 100(1,N) are disposed in the same row, and the pixel circuits 100(M,1) to 100(M,N) are disposed in the same row. The pixel circuits 100(1,1) to 100(1,N) are coupled to the common voltage line COM1, the first control line CG1, the second control line EN1, and the third control line SH1. However, the pixel circuit 100(1,1) is coupled to the source line SL1 while the pixel circuit 100(1,N) is coupled to the source line SLN. Similarly, the pixel circuits 100(M,1) to 100(M,N) are coupled to the common voltage line COMM, the first control line CGM, the second control line ENM, and the third control line SHM. However, the pixel circuit 100(M,1) is coupled to the source line SL1 while the pixel circuit 100(M,N) is coupled to the source line SLN.

The source driver 12 can drive the source lines SL1 to SLN, and the control driver 13 can drive the first control lines CG1 to CGM, the second control lines EN1 to ENM, and the third control lines SH1 to SHM. In some embodiments, the control driver 13 may include different control circuits for controlling the different control lines. Also, the common voltage lines COM1 to COMM may also be driven by the control driver 13 according to the system requirements in some embodiments.

Figure 2:
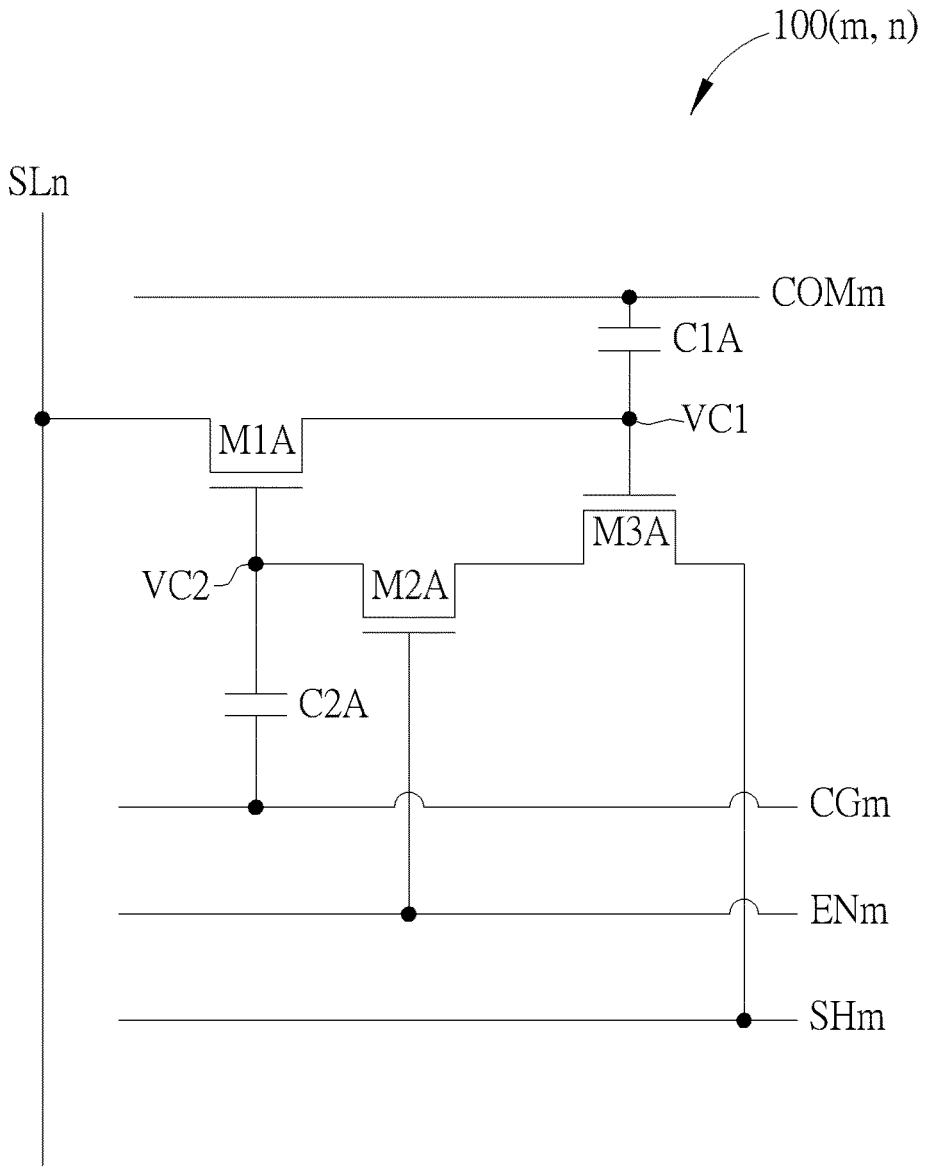
FIG. 2 shows the block diagram of the pixel circuit in the display driver in FIG. 1.

As is made as an example, FIG. 2 shows the block diagram of the pixel circuit 100(*m,n*) in the display device 10, wherein m is a positive integer no greater than M, and n is a positive integer no greater than N. The pixel circuit 100(*m,n*) includes a first capacitor C1A, a second capacitor C2A, a first transistor M1A, a second transistor M2A, and a third transistor M3A.

The first capacitor C1A has a first terminal and a second terminal. The first terminal of the first capacitor C1A is coupled to a common voltage line COMm. The second capacitor C2A has a first terminal and a second terminal. The first terminal of the second capacitor C2A is coupled to the first control line CGm.

The first transistor M1A has a first terminal, a second terminal, and a control terminal. The first terminal of the first transistor M1A is coupled to the source line SLn, the second terminal of the first transistor M1A is coupled to the second terminal of the first capacitor C1A, and the control terminal of the first transistor M1A is coupled to the second terminal of the second capacitor C2A. The second transistor M2A has a first terminal, a second terminal, and a control terminal. The first terminal of the second transistor M2A is coupled to the control terminal of the first transistor M1A, the control terminal of the second transistor M2A is coupled to the second control line ENm. The third transistor M3A has a first terminal, a second terminal, and a control terminal. The first terminal of the third transistor M3A is coupled to the second terminal of the second transistor M2A, the second terminal of the third transistor M3A is coupled to the third control line SHm, and the control terminal of the third transistor M3A is coupled to the second terminal of the first transistor M1A.

In pixel circuit 100(*m,n*), the first capacitor C1A can store the corresponding image data, that is, the pixel data voltage corresponding to image data to be shown. For example, a polarity voltage applied to the common voltage line COMm can be transmitted to the first terminal of the first capacitor C1A, and the second terminal of the first capacitor C1A can receive the data voltage through the first transistor M1A from the source line SLn during a write process of the pixel circuit 100(*m,n*). In this case, the pixel voltage received by the pixel circuit 100(*m,n*) would be the voltage difference between the polarity voltage and the data voltage. In some embodiments, the polarity voltage may be alternated in different periods for avoiding the ageing of the materials used by the pixel circuit 100(*m,n*), for instance the liquid crystal material.

Also, the first control line CGm, the second control line ENm, and the third control line SHm can be used to control the processes of the pixel circuit 100(*m,n*), including the initialization process, the refreshing process, and the write process.

Figure 3:
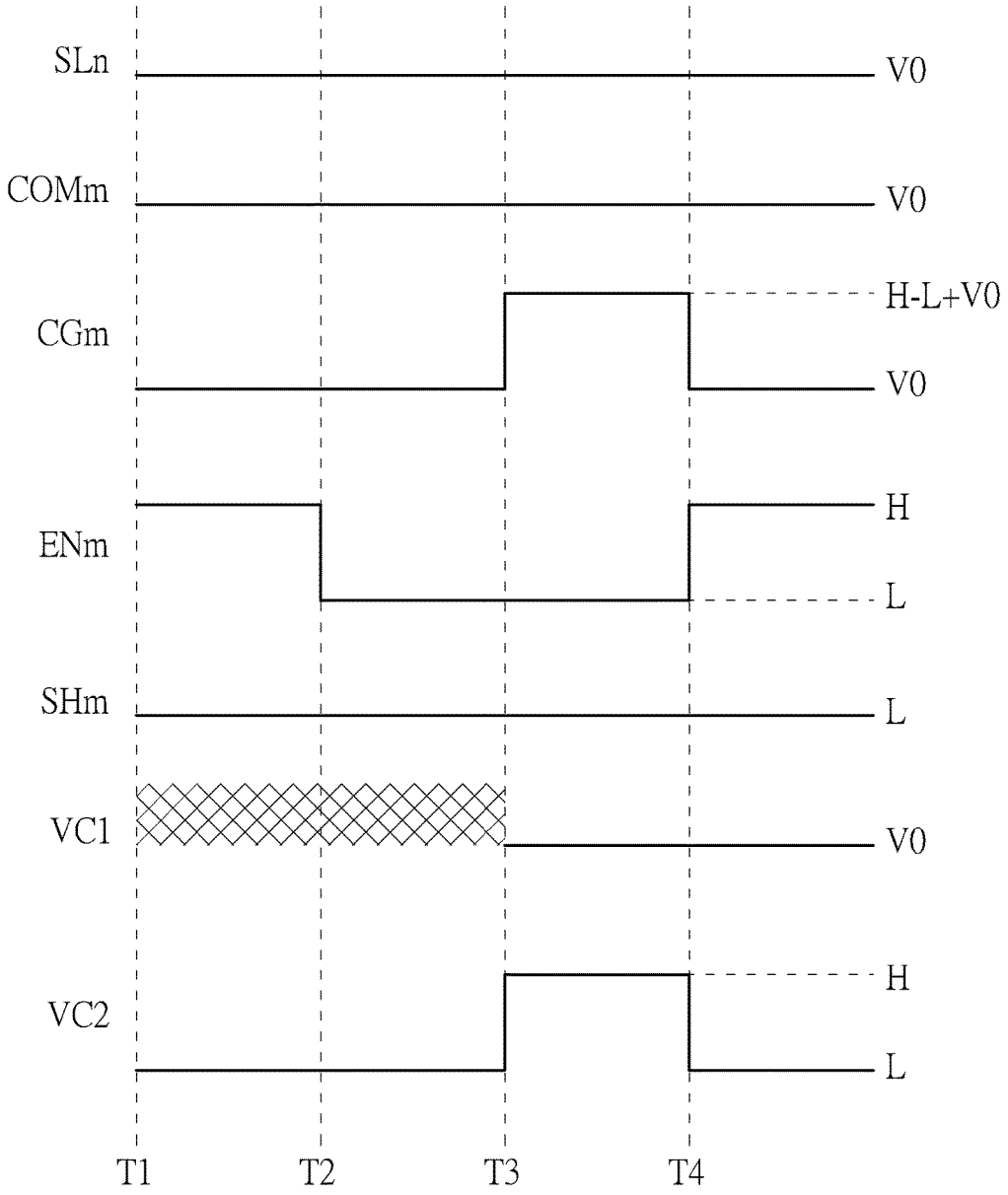
FIG. 3 shows a timing diagram of the signals received by the pixel circuit in FIG. 2 during the initialization process.

FIG. 3 shows a timing diagram of the signals received by the pixel circuit 100(*m,n*) during the initialization process. Also, the voltage VC1 of the second terminal of the first capacitor C1A and the voltage VC2 of the second terminal of the second capacitor C2A are also shown in FIG. 3 for explanation.

At time T1, the source line SLn, the common voltage line COMm, and the first control line CGm can be at a reference voltage V0, the second control line ENm can be at a high voltage H, and the third control line SHm can be at a low voltage L. Also, the voltage VC1 may be at an unspecified voltage according to its previous operations. In some embodiments, the reference voltage V0 can be, for example, the system ground voltage or 0V. Also, the high voltage H is higher than the reference voltage V0, and is higher than the highest data voltage of the pixel circuit 100(*m,n*). The low voltage L is lower than the reference voltage V0, and is lower than the lowest data voltage of the pixel circuit 100(*m,n*).

Therefore, at time T1, the second transistor M2A and the third transistor M3A are turned on. The third transistor M3A is turned on because the second terminal of the third transistor M3A accepts the low voltage L is lower than the reference voltage V0. In this case, the voltage VC2 would be at the low voltage L, and the first control line CGm would keep the first terminal of the second capacitor C2A at the reference voltage V0.

At time T2, the voltage of the second control line ENm is changed to the low voltage L so the second transistor M2A is turned off.

At time T3, the voltage of the first control line CGm is changed to (H−L+V0). Since there is no discharging path for the second capacitor C2A, the voltage VC2 would be raised to the high voltage H when the voltage of the first control line CGm is changed to the voltage (H−L+V0). Consequently, the first transistor M1A is turned on, and the first capacitor C1A would be discharged, so the voltage VC1 is at the reference voltage V0 as shown in FIG. 3.

At time T4, the voltage of the first control line CGm is changed to the reference voltage V0, and the voltage of the second control line ENm is changed to the high voltage H. In this case, the pixel circuit 100(*m,n*) enters to a stable suspending status. When in the suspending status, the second transistor M2A and the third transistor M3A are both turned on to keep the voltage VC2 at the low voltage L, ensuring the first transistor M1A to be turned off and preserving the charges stored in the first capacitor C1A.

In some embodiments, the operations executed at time T2 and time T3 in FIG. 3 can be executed at the same time, that is, the voltage of the second control line ENm and the voltage of the first control line CGm can be changed at the same time. In this case, the initialization process may be performed even faster.

Figure 4:
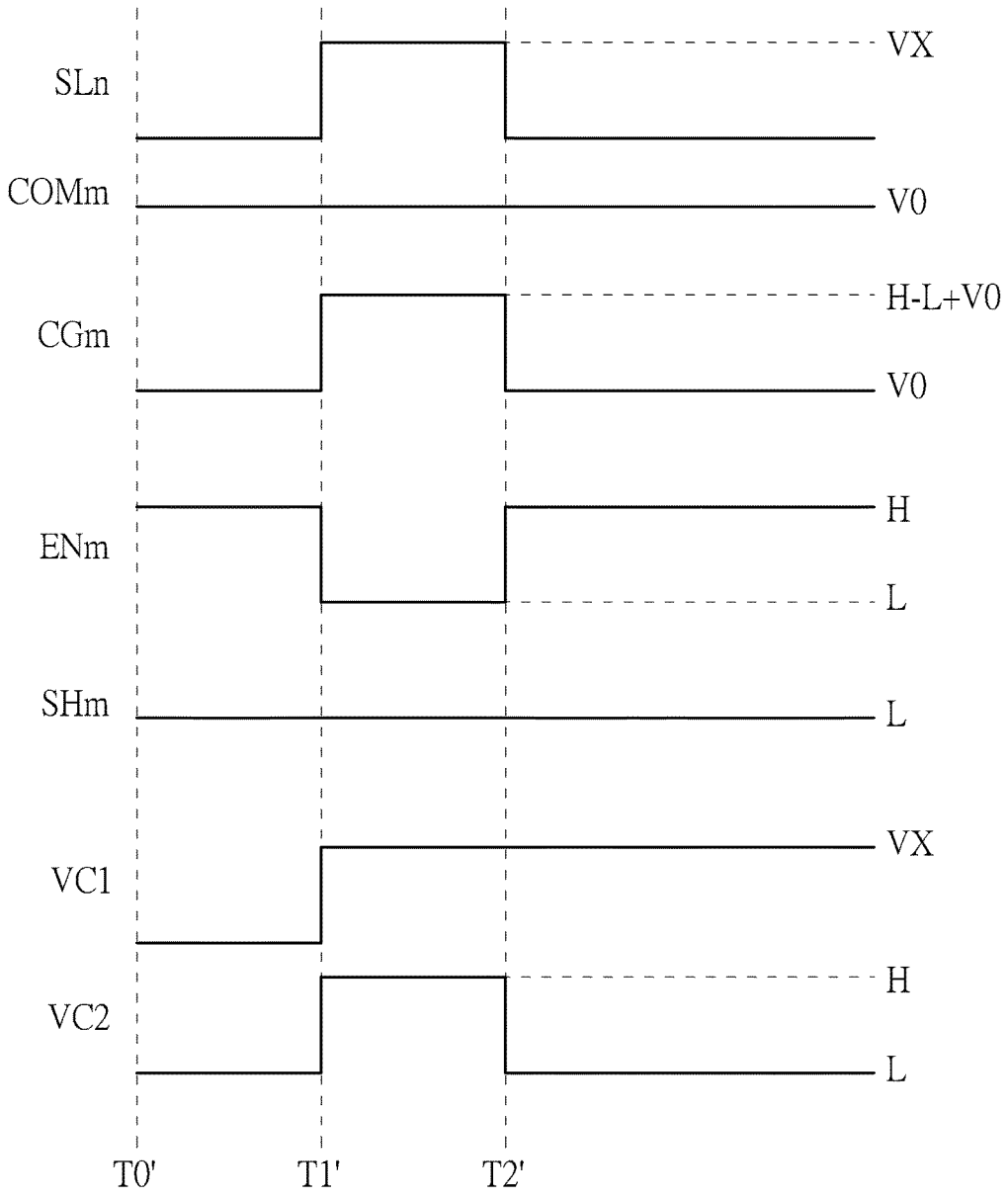
FIG. 4 shows a timing diagram of the signals received by the pixel circuit in FIG. 2 during the write process.

FIG. 4 shows a timing diagram of the signals received by the pixel circuit 100(*m,n*) during the write process.

In FIG. 4, the pixel circuit 100(*m,n*) is in the suspending status at time T0'. At time T1' of FIG. 4, the voltage of the first control line CGm is changed to the voltage (H−L+V0), and the voltage of the second control line ENm is changed to the low voltage L. Therefore, the first transistor M1A is turned on and the second transistor M2A is turned off. The voltage of the source line SLn is raised to the data voltage VX so as to raise the voltage VC1 to the data voltage VX.

At time T2', the pixel circuit 100(*m,n*) enters to the suspending status again, and is ready for the next write process or the refreshing process.

The same process shown in FIG. 4 can be applied to all the pixel circuits 100(1,1) to 100(M,N) to write the corresponding image data. In some embodiments, the pixel circuits 100(1,1) to 100(M,N) can be written row by row. For example, when the voltage of the first control line CGm changes to the voltage (H−L+V0), and the voltage of the second control line ENm changes to the low voltage L at time T1' as shown in FIG. 4, the source driver 12 can drive the source lines SL1 to SLN to send the corresponding data voltages. Therefore, the pixel circuits 100(*m*,1) to 100(*m*,N) would be written accordingly during the same process. Meanwhile, since the first control lines other than the first control line CGm can remain at the reference voltage V0 and the second control lines other than the second control line ENm can remain at the high voltage H, pixel circuits in rows other than the $m^{th}$ row would not be written.

In some embodiments, the display device 10 can support 2-bit image data. In this case, the data voltage VX can be one of the first data voltage V1, the second data voltage V2, the third data voltage V3, and the fourth data voltage V4. Each data voltage is corresponding to one of the image data "00", "01", "10", and "11". According to the values of the data voltage stored by the first capacitor C1A, the pixel circuits 100(1,1) to 100(M,N) would be able to show different brightness correspondingly. Therefore, when all the pixel circuits 100(1,1) to 100(M,N) are written with the corresponding data voltages, the display device 10 would be able to present the image with four grey levels accordingly.

In some embodiments, the fourth data voltage V4 can be greater than the third data voltage V3, the third data voltage V3 can be greater than the second data voltage V2, the second data voltage V2 can be greater than the first data voltage V1, and the first data voltage V1 can be greater than or equal to the reference voltage V0. In this case, when the common voltage lines COM1 to COMM are at a low polarity voltage VCL, the second terminal of the first capacitor C1A can be charged to the fourth data voltage V4 to represent the image data "11", can be charged to the third data voltage V3 to represent the image data "10", can be charged to the second data voltage V2 to represent the image data "01", and can be charged to the first data voltage V1 to represent the image data "00".

However, in some embodiments, the common voltage lines COM1 to COMM may change the polarity voltages for preventing the pixel material from ageing. In this case, if the polarity voltage of the common voltage line COMm is changed from the low polarity voltage to a high polarity voltage, then the second terminal of the first capacitor C1A could be charged to the first data voltage V1 to represent the image data "11", and could be charged to the second data voltage V2 to represent the image data "10". Also, the second terminal of the first capacitor C1A could be charged to the third data voltage V3 to represent the image data "01", and could be charged to the fourth data voltage V4 to represent the image data "00". That is, the charges stored in the first capacitor C1A can remain the same even after the polarity voltage changes to present the same brightness.

In the present embodiment, the low polarity voltage VCL and the reference voltage V0 can be 0V, the high polarity voltage VCH can be 6V, the first data voltage V1 can be 0V, the second data voltage V2 can be 2V, the third data voltage V3 can be 4V, and the fourth voltage can be 6V, but that is not limited to the disclosure.

In some embodiments, when the display device 10 is intended to show the same image for a period of time, instead of repeatedly writing the same image data to the pixel circuits 100(1,1) to 100(M,N), the refreshing process can be applied.

Figure 5:
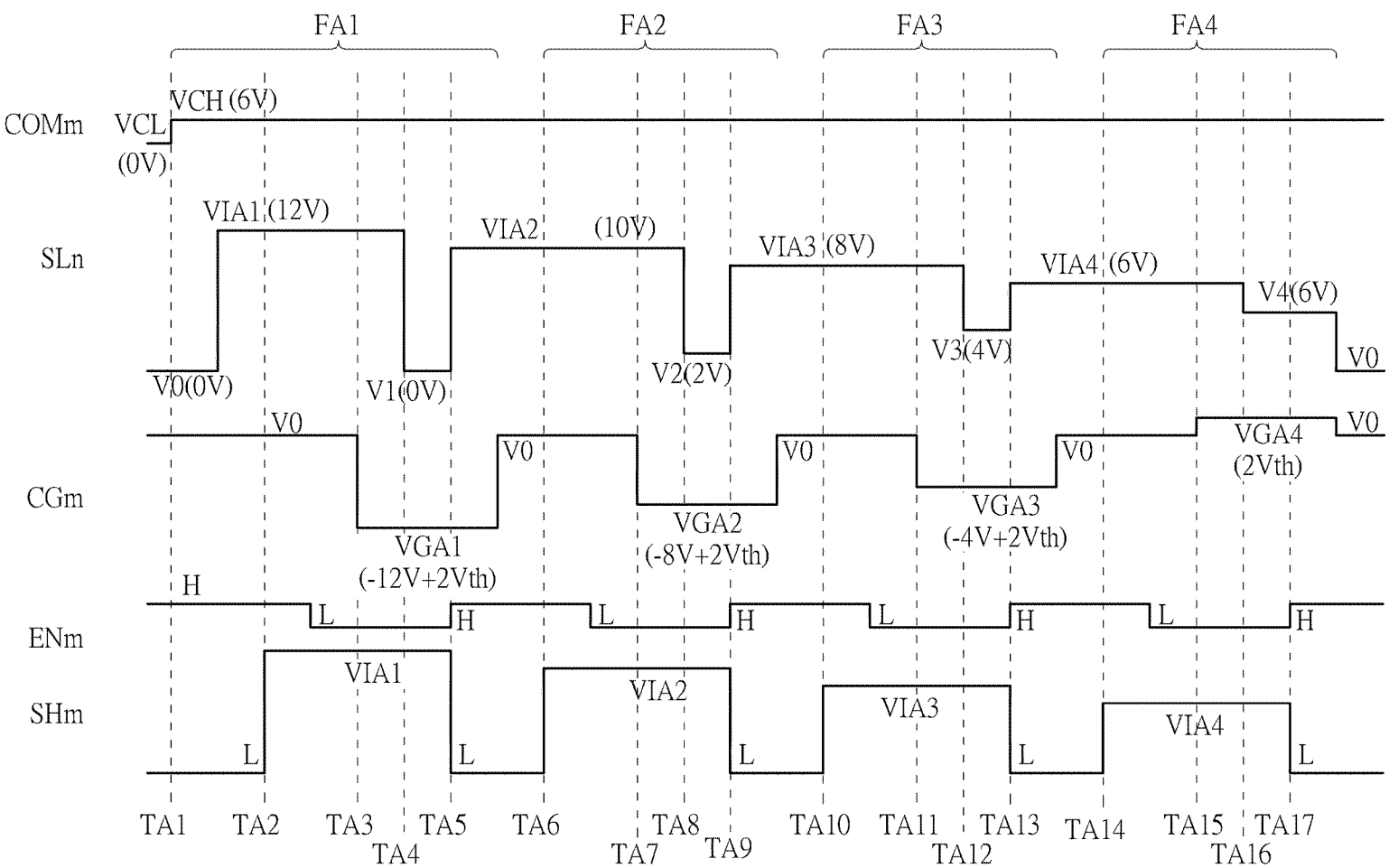
FIG. 5 shows a timing diagram of the signals received by the pixel circuit in FIG. 2 during the four refreshing processes with the common voltage changing from the low polarity voltage to the high polarity voltage.
Figure 6:
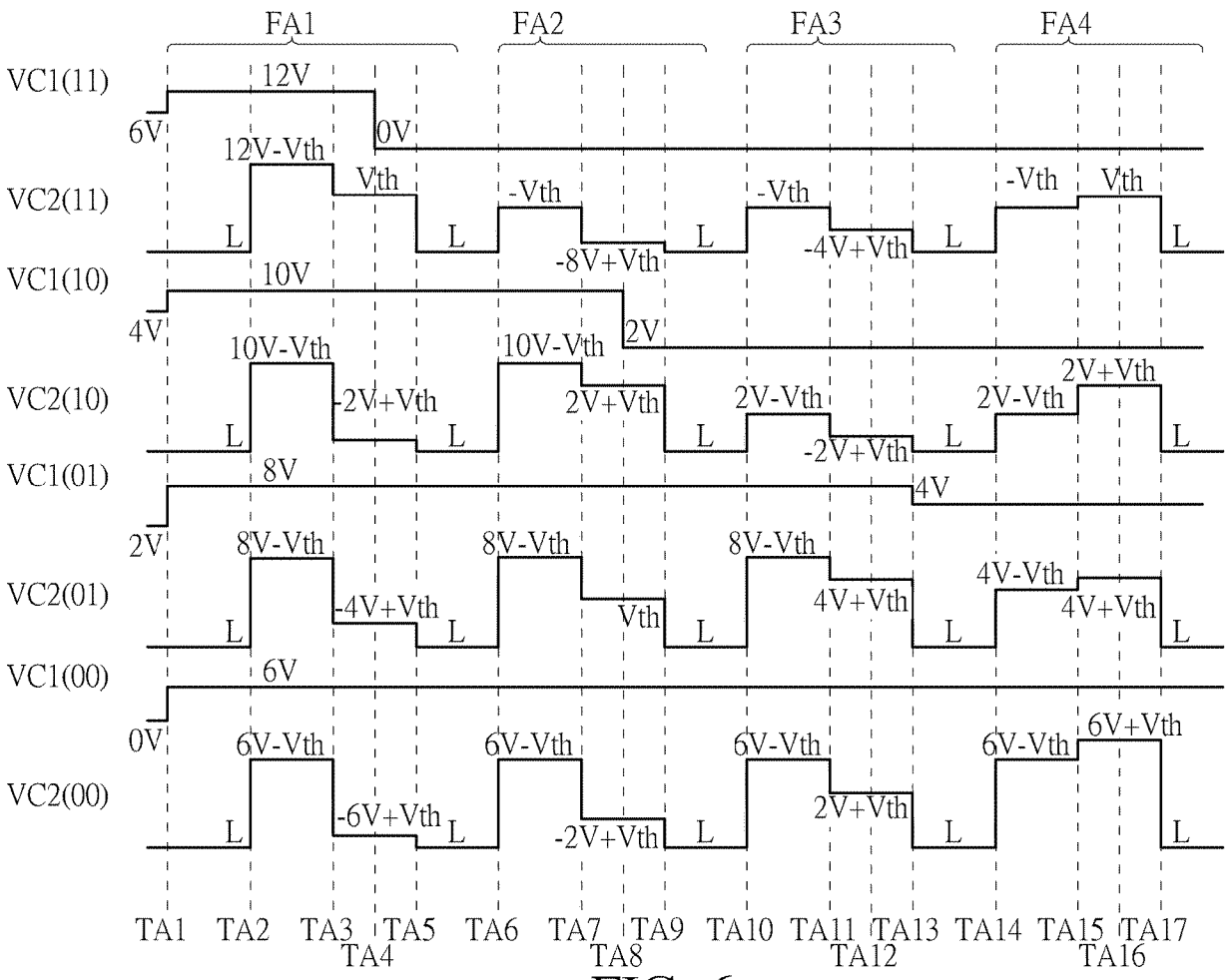
FIG. 6 shows the voltages of the first capacitor and the second capacitor with the image data being "11", "10", "01", and "00" according to the waveform shown in FIG. 5.

FIG. 5 shows a timing diagram of the signals received by the pixel circuit 100(*m,n*) during the four refreshing processes with the common voltage changing from the low polarity voltage VCL to the high polarity voltage VCH. FIG. 6 shows the voltages VC1 of the second terminal of the first capacitor C1A and the voltages VC2 of the second terminal of the second capacitor C2A with the image data stored in the pixel circuit 100(*m,n*) being "11", "10", "01", and "00" according to the waveform shown in FIG. 5.

In addition, although FIG. 5 shows the voltages received by the pixel circuit 100(*m,n*) as an example for explanation, the pixel circuits 100(1,1) to 100(M,N) can all receive the same voltages as shown in FIG. 5 simultaneously, so the pixel circuits 100(1,1) to 100(M,N) can all be refreshed during the same refreshing processes.

In FIG. 5, before the first refreshing process FA1 starts, the pixel circuit 100(*m,n*) is in the suspending status with the corresponding image data being written.

In the first refreshing process FA1, the voltage of the common voltage line COMm changes from the low polarity voltage VCL to the high polarity voltage VCH at time TA1. The voltage VC1 is raised accordingly. For example, in FIG. 6, if the pixel circuit 100(*m,n*) stores the image data "11", then the voltage VC1 would be raised from 6V to 12V. Similarly, if the pixel circuit 100(*m,n*) stores the image data "10", then the voltage VC1 would be raised from 4V to 10V, and so on.

Next, the voltage of the source line SLn is changed from the reference voltage V0 to a first intermediate voltage VIA1. The first intermediate voltage VIA1 can be the fourth data voltage V4 plus the difference between the low polarity voltage VCL and the high polarity voltage VCH. In this case, the first intermediate voltage VIA1 would be (6V+6V), resulting in 12V. Also, in the present embodiment, the high voltage H can be higher than the first intermediate voltage VIA1.

At time TA2, the voltage of the third control line SHm is changed from the low voltage L to the first intermediate voltage VIA1. In this case, the second terminal of the second capacitor C2A would be charged to a sample voltage according to the voltage stored in the first capacitor C1A. For example, in FIG. 6, if the voltage VC1 is raised to 12V previously (for pixel circuit 100(*m,n*) storing image data "11"), then the voltage VC2 would be charged to (12V−Vth) when the third transistor M3A is finally turning off, wherein Vth is the threshold voltage of the third transistor M3A. Similarly, if the voltage VC1 is raised to 10V (for pixel circuit 100(*m,n*) storing image data "10"), then the voltage VC2 would be charged to (10V−Vth) when the third transistor M3A is finally turned off.

After the second terminal of the second capacitor C2A is charged accordingly, the voltage of the second control line ENm is changed from the high voltage H to the low voltage L, and the second transistor M2A is turned off. Since the sample voltage received by the second terminal of the second capacitor C2A is controlled by the voltage VC1 through the control terminal of the third transistor M3A, the charges stored in the first capacitor C1A will not dissipate during the charging process of the second capacitor C2A. Therefore, the display device 10 is able to preserve the brightness and reduce the flickers.

At time TA3, the voltage of the first control line CGm is changed from the reference voltage V0 to a first gate push voltage VGA1. In some embodiments, the threshold voltage of the first transistor M1A is substantially equal to the threshold voltage Vth of the third transistor M3A. In this case, the first gate push voltage VGA1 can be set as the first data voltage V1 plus two times the threshold voltage Vth of the first transistor M1A and minus the first intermediate voltage VIA1, that is, (V1+2Vth−VIA1), or (−12V+2Vth). Since the second transistor M2A is turned off, there is no discharge path available for the second terminal of the second capacitor C2A. Consequently, the voltage VC2 of the second terminal of the second capacitor C2A would also drop as the voltage of the first control line CGm changes to the first gate push voltage VGA1.

For example, in FIG. 6, if the image data stored in the pixel circuit 100(*m,n*) is"11", then the voltage VC2 will drop from (12V−Vth) to Vth when the voltage of the first control line CGm changes to the first gate push voltage VGA1. Similarly, if the image data stored in the pixel circuit 100(*m,n*) is "10", then the voltage VC2 will drop from (10V−Vth) to (−2V+Vth) when the voltage of the first control line CGm changes to the first gate push voltage VGA1.

At time TA4, the voltage of the source line SLn is changed from the first intermediate voltage VIA1 to the first data voltage V1. In this case, the first transistor M1A would be turned on or turned off according to the image data stored in the pixel circuit 100(*m,n*).

For example, in FIG. 6, if the image data stored in the pixel circuit 100(*m,n*) is "11", then the voltage VC2 would be at Vth, which is greater than the first data voltage V1 (0V) by the threshold voltage Vth, so the first transistor M1A is turned on, and the voltage VC1 would also be set to the first data voltage V1 (0V). That is, the pixel circuit 100(*m,n*) storing image data "11" can be refreshed to the data voltage corresponding to the polarity voltage change of the common voltage line COMm.

However, if the image data stored in the pixel circuit 100(*m,n*) is "10", then the voltage VC2 would be at (−2V+Vth), which is lower than the first data voltage V1 (0V), so the first transistor M1A is turned off, and the pixel circuit 100(*m,n*) will not be refreshed. Similarly, if the image data stored in the pixel circuit 100(*m,n*) is "01" or "00", then the pixel circuit 100(*m,n*) will not be refreshed in the first refreshing process FA1.

At time TA5, the voltage of the second control line ENm is changed from the low voltage L to the high voltage H, and the voltage of the third control line SHm is changed from the first intermediate voltage VIA1 to the low voltage L. Then, the voltage of the first control line CGm is changed from the first gate push voltage VGA1 to the reference voltage V0. Therefore, the pixel circuit 100(*m,n*) enters the suspending status again. In some embodiments, the voltage of the first control line CGm can be changed to the reference voltage V0 between time TA5 and time TA6, i.e. the voltage of the first control line CGm can be changed to the reference voltage V0 at time TA5 or time TA6.

Also, in FIG. 5, the voltage of the source line SLn can be changed from the first data voltage V1 to a second intermediate voltage VIA2 for the coming second refreshing period FA2. The second intermediate voltage VIA2 can be the third data voltage V3 plus the difference between the low polarity voltage VCL and the high polarity voltage VCH. In this case, the second intermediate voltage VIA2 would be (4V+6V), resulting in 10V.

During the second refreshing process FA2, the voltage of the third control line SHm is changed from the low voltage L to the second intermediate voltage VIA2 at time TA6. In this case, the voltage VC2 would be adjusted to a sample voltage according to the voltage VC1 of the second terminal of the first capacitor C1A.

For example, at time TA6 in FIG. 6, if the image data stored in the pixel circuit 100(*m,n*) is "11", then the voltage VC1 would be at 0V after being refreshed in the first refreshing process FA1. Therefore, the voltage VC2 would be set to (−Vth) when the third transistor M3A is finally turned off after time TA6.

However, if the image data stored in the pixel circuit 100(*m,n*) is "10", then the voltage VC1 would be raised to 10V during the first refreshing process FA1 when the common voltage lines COMm changes polarity. Therefore, the voltage VC2 would be charged to (10V−Vth) when the third transistor M3A is finally turned off after time TA6.

Similarly, if the image data stored in the pixel circuit 100(*m,n*) is "01", then the voltage VC1 would be raised to 8V during the first refreshing process FA1 when the common voltage lines COMm changes polarity. Therefore, the voltage VC2 would be charged to (8V−Vth) when the third transistor M3A is finally turned off after time TA6.

After the second capacitor C2A is charged accordingly, the second control line ENm is changed from the high voltage H to the low voltage L, and the second transistor M2A is turned off.

At time TA7, the first control line CGm is changed from the reference voltage V0 to a second gate push voltage VGA2. The second gate push voltage VGA2 can be set as the second data voltage V2 plus the two times the threshold voltage Vth of the first transistor M1A and minus the second intermediate voltage VIA2, which is (V2+2Vth−VIA2), or (−8V+2Vth) in the present embodiment. Since the second transistor M2A is turned off, there is no discharge path available for the second terminal of the second capacitor C2A. Consequently, the voltage VC2 would also drop as the voltage of the first control line CGm changes to the second gate push voltage VGA2.

For example, at time TA7 in FIG. 6, if the image data stored in the pixel circuit 100(*m,n*) is "11", then the voltage VC2 will drop from (−Vth) to (−8V+Vth) when the voltage of the first control line CGm changes to the second gate push voltage VGA2. Similarly, if the image data stored in the pixel circuit 100(*m,n*) is "10", then the voltage VC2 will drop from (10V−Vth) to (2V+Vth) when the voltage of the first control line CGm changes to the second gate push voltage VGA2. Also, if the image data stored in the pixel circuit 100(*m,n*) is "01", then the voltage VC2 will drop from (8V−Vth) to (Vth) when the voltage of the first control line CGm changes to the second gate push voltage VGA2, and so on.

At time TA8, the voltage of the source line SLn is changed from the second intermediate voltage VIA2 to the second data voltage V2. In this case, the first transistor M1A would be turned on or turned off according to the image data stored in the pixel circuit 100(*m,n*).

For example, at time TA8 in FIG. 6, if the image data stored in the pixel circuit 100(*m,n*) is "11", then the voltage VC2 would be at (−8V+Vth), which is lower than the second data voltage V2 (2V) on the source line SLn, so the first transistor M1A is turned off, and the pixel circuit 100(*m,n*) would not be refreshed.

Or, if the image data stored in the pixel circuit 100(*m,n*) is "01", then the voltage VC2 would be at Vth, which is still lower than the second data voltage V2 (2V) source line SLn, so the first transistor M1A is turned off, and the pixel circuit 100(*m,n*) would not be refreshed. Similarly, if the image data stored in the pixel circuit 100(*m,n*) is "00", then the pixel circuit 100(*m,n*) will not be refreshed in the second refreshing process FA2.

However, if the image data stored in the pixel circuit 100(*m,n*) is "10", then the voltage VC2 would be at (2V+Vth), which is higher than the second data voltage V2 by a threshold voltage Vth of the first transistor M1A, so the first transistor M1A is turned on, and the voltage VC1 would also be at the second data voltage V2 (2V) as the source line SLn. That is, the pixel circuit 100(*m,n*) storing image data "10" can be refreshed in the second refreshing process FA2.

At time TA9, the voltage of the second control line ENm is changed from the low voltage L to the high voltage H, and the voltage of the third control line SHm is changed from the second intermediate voltage VIA2 to the low voltage L. Then, the voltage of the first control line CGm is changed from the second gate push voltage VGA2 to the reference voltage V0. Therefore, the pixel circuit 100(*m,n*) would enter the suspending status. In some embodiments, the voltage of the first control line CGm can be changed to the reference voltage V0 between time TA9 and time TA10, i.e. the voltage of the first control line CGm can be changed to the reference voltage V0 at time TA9 or time TA10.

In addition, at time TA9 in FIG. 5, the voltage of the source line SLn can be changed from the second data voltage V2 to a third intermediate voltage VIA3 for the coming third refreshing period FA3.

The third intermediate voltage VIA3 can be the second data voltage V2 plus the difference between the low polarity voltage VCL and the high polarity voltage VCH. In this case, the third intermediate voltage VIA3 would be (2V+6V), resulting in 8V.

The third refreshing process FA3 has similar operations as the second refreshing process FA2. That is, the voltage of the third control line SHm can be changed from the low voltage L to the third intermediate voltage VIA3 at time TA10, so the voltage VC2 would be charged to a sample voltage according to the image data stored in the pixel circuit 100(*m,n*). Next, the second control line ENm would be changed from the high voltage H to the low voltage L, turning off the second transistor M2A. At time TA11 the voltage of the first control line CGm is changed from the reference voltage V0 to a third push voltage VGA3. The third gate push voltage VGA3 is substantially equal to the third data voltage V3 plus the two times the threshold voltage Vth and minus the third intermediate voltage VIA3, which is (V3+2Vth−VIA3), or (−4V+2Vth) in the present embodiment. Meanwhile, the voltage VC2 would be dropped as the first control line CGm changing from the reference voltage V0 to the third push voltage VGA3 as shown in FIG. 6.

At time TA12, the voltage of the source line SLn is changed from the third intermediate voltage VIA3 to the third data voltage V3. In this case, if the image data stored in the pixel circuit 100(*m,n*) is "01", then the first transistor M1 would be turned on, and the pixel circuit 100(*m,n*) would be refreshed. Otherwise, the pixel circuit 100(*m,n*) would not be refreshed.

At time TA13, the voltage of the second control line ENm is changed from the low voltage L to the high voltage H, and the voltage of the third control line SHm is changed from the third intermediate voltage VIA3 to the low voltage L. Then, the voltage of the first control line CGm is changed from the third gate push voltage VGA3 to the reference voltage V0. Therefore, the pixel circuit 100(*m,n*) would enter the suspending status. In some embodiments, the voltage of the first control line CGm can also be changed to the reference voltage V0 between time TA13 and time TA14, i.e. the voltage of the first control line CGm can be changed to the reference voltage V0 at time TA13 or time TA14.

Furthermore, at time TA 13 in FIG. 5, the source line SLn can be changed from the third data voltage V3 to a fourth intermediate voltage VIA4 for the coming fourth refreshing period FA4. The fourth intermediate voltage VIA4 can be the first data voltage V1 plus the difference between the low polarity voltage VCL and the high polarity voltage VCH. In this case, the fourth intermediate voltage VIA4 would be (0V+6V), resulting in 6V.

The fourth refreshing process FA4 has similar operations as the previous refreshing processes. That is, the voltage of the third control line SHm can be changed from the low voltage L to the fourth intermediate voltage VIA4 at time TA14, so the second terminal of the second capacitor C2A would be charged to a sample voltage according to the image data stored in the pixel circuit 100(*m,n*). Next, the second control line ENm would be changed from the high voltage H to the low voltage L, turning off the second transistor M2A. At time TA15, the voltage of the first control line CGm is changed from the reference voltage V0 to a fourth push voltage VGA4. The fourth gate push voltage VGA4 can be set as the fourth data voltage V4 plus the two times the threshold voltage Vth and minus the fourth intermediate voltage VIA4, which is (V4+2Vth−VIA4), or (2Vth) in the present embodiment. Meanwhile, the voltage VC2 would be changed as the first control line CGm changing from the reference voltage V0 to the fourth push voltage VGA4 as shown in FIG. 6.

At time TA16, the voltage of the source line SLn is changed from the fourth intermediate voltage VIA4 to the fourth data voltage V4. In this case, if the image data stored in the pixel circuit 100(*m,n*) is "00", then the first transistor M1A would be turned on, and the pixel circuit 100(*m,n*) would be refreshed. Otherwise, the pixel circuit 100(*m,n*) would not be refreshed. At time TA17, the voltage of the second control line ENm is changed from the low voltage L to the high voltage H, and the voltage of the third control line SHm is changed from the fourth intermediate voltage VIA4 to the low voltage L. Then, the voltage of the first control line CGm is changed from the fourth gate push voltage VGA4 to the reference voltage V0, and the voltage of the source line SLn can be changed from the fourth data voltage V4 to the reference voltage V0; therefore, the pixel circuit 100(*m,n*) would enter the suspending status. In some embodiments, the voltage of the first control line CGm and the voltage of the source line SLn can both be changed to the reference voltage V0 at time TA17.

According to the timing diagram shown in FIGS. 5 and 6, pixel circuits storing images data "11", "10", "01", "00" can be refreshed in the refreshing processes FA1, FA2, FA3, and FA4 respectively. Also, since the data voltage stored in the first capacitor C1A is sampled by the control terminal of the third transistors M3A at time TA2, TA6, TA10, TA14 in FIG. 5, the charges stored in the first capacitor C1A will not dissipate during the refreshing processes, reducing the flickers.

Figure 7:
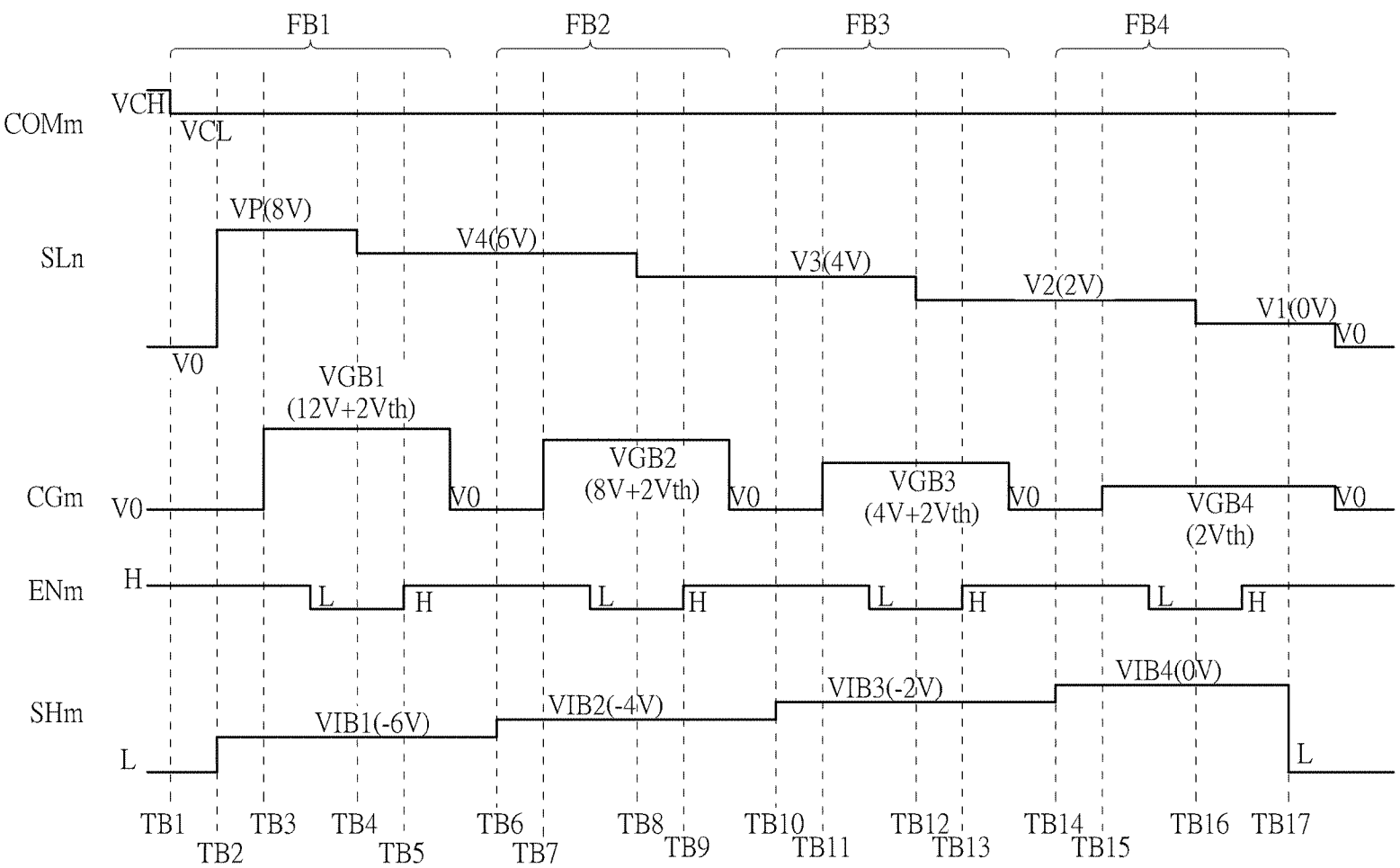
FIG. 7 shows a timing diagram of the signals received by the pixel circuit in FIG. 2 during the four refreshing processes with the common voltage changing from the high polarity voltage to the low polarity voltage.
Figure 8:
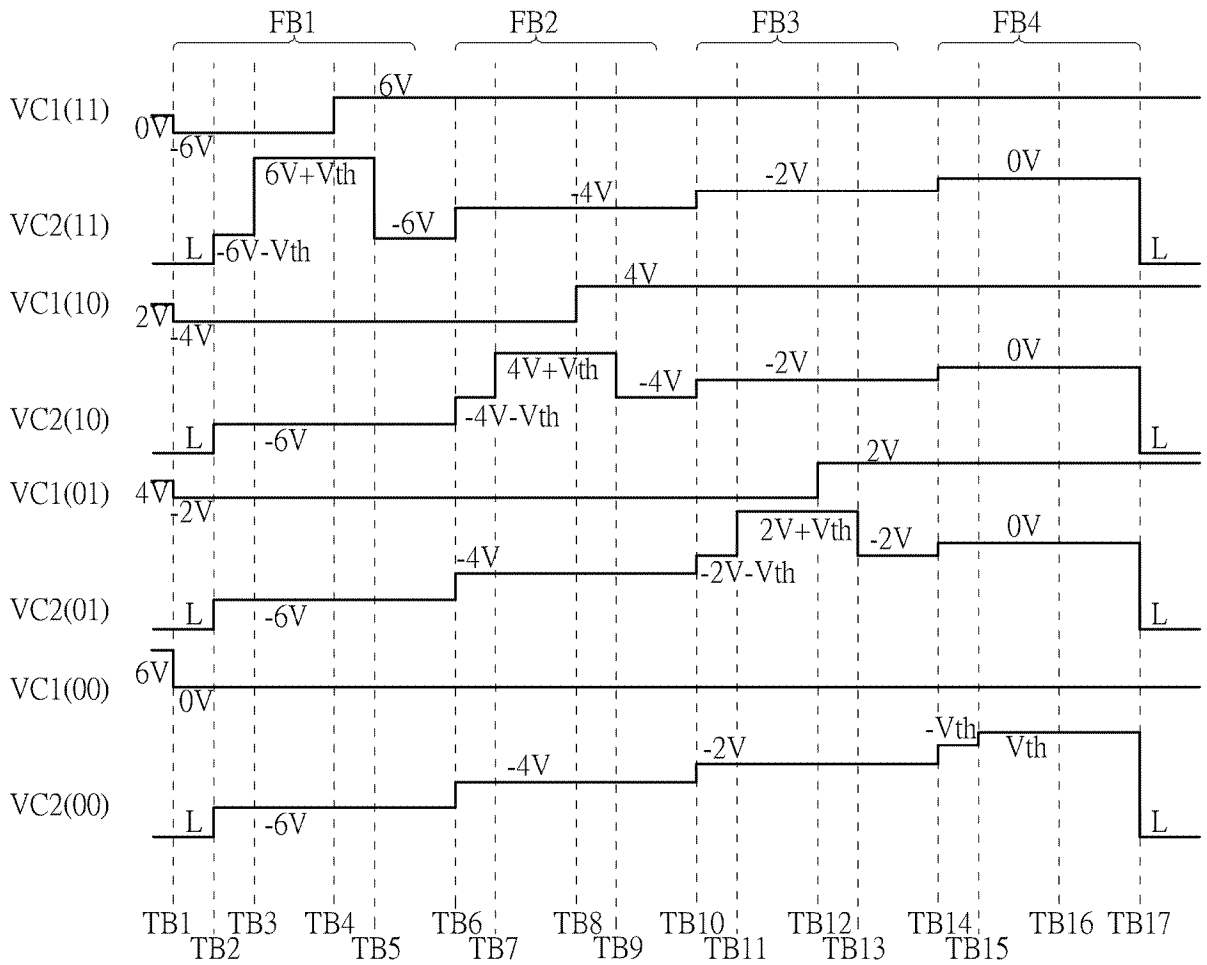
FIG. 8 shows the voltages of the first capacitor and the second capacitor with the image data being "11", "10", "01", and "00" according to the waveform shown in FIG. 7.

FIG. 7 shows a timing diagram of the signals received by the pixel circuit 100(*m,n*) during the four refreshing processes FB1 to FB4 with the common voltage changing from the high polarity voltage VCH to the low polarity voltage VCL. FIG. 8 shows the voltages VC1 of the second terminal of the first capacitor C1A and the voltages VC2 of the second terminal of the second capacitor C2A with the image data stored in the pixel circuit 100(*m,n*) being "11", "10", "01", and "00" according to the waveform shown in FIG. 7.

In FIG. 7, before the first refreshing process FB1, the pixel circuit 100(*m,n*) is in a suspending status with the corresponding image data being written previously.

In the first refreshing process FB1, the voltage of the common voltage line COMm changes from the high polarity voltage VCH to the low polarity voltage VCL at time TB1. The voltage VC1 is dropped accordingly. For example, in FIG. 8, if the pixel circuit 100(*m,n*) stores the image data "11", then the voltage VC1 would be dropped from 0V to (−6V). Similarly, if the pixel circuit 100(*m,n*) stores the image data "10", then the voltage VC1 would be dropped from 2V to (−4V), and so on.

At time TB2, the voltage of the source line SLn is changed from the reference voltage V0 to a prepare voltage VP, and the voltage of third control line SHm is changed from the low voltage L to a first intermediate voltage VIB1. The prepare voltage VP can be higher than the fourth data voltage V4 by at least the threshold voltage Vth of the first transistor M1A, that is, can be (6V+Vth) or higher, and the first intermediate voltage VIB1 can be the first data voltage V1 minus the difference between the high polarity voltage VCH and the low polarity voltage VCL. In the present embodiment, the prepare voltage VP can be 8V, and the first intermediate voltage VIB1 can be (−6V). In this case, the voltage VC2 would be charged according to the image data stored in the pixel circuit 100(*m,n*).

For example, at time TB2 in FIG. 8, if the image data stored in the pixel circuit 100(*m,n*) is "11", then the voltage VC2 would be charged (−6−Vth) since the third transistor M3A will finally be turned off due to the voltage VC1 being at (−6V). However, if the image data stored in the pixel circuit 100(*m,n*) is "10", "01", or "00", then the voltage VC2 would be charged (−6V) since the voltage VC1 would be higher than (−6V) and the third transistor M3A remains turned on.

At time TB3, the voltage of the first control line CGm is changed from the reference voltage V0 to a first gate push voltage VGB1. The first gate push voltage VGB1 can be set as the fourth data voltage V4 plus two times the threshold voltage Vth and minus the first intermediate voltage VIB1, which is (V4+2Vth−VIB1), resulting in (12V+2Vth). In FIG. 8 at time TB3, if the image data stored in the pixel circuit 100(*m,n*) is "11", then the third transistor M3A would still be turned off so the voltage VC2 will be raised to (6V+Vth) as the voltage of the first control line CGm changes. However, if the image data stored in the pixel circuit 100(*m,n*) is "10", "01", or "00", then the third transistor M3A would still be turned on so the voltage VC2 of the second terminal of the second capacitor C2A will remain at (−6V).

Next, the voltage of the second control line ENm is changed from the high voltage H to the low voltage L, turning off the second transistor M2A. At time TB4, the voltage of source line SLn is changed from the prepare voltage VP to the fourth data voltage V4. In FIG. 8 at time TB4, if the image data stored in the pixel circuit 100(*m,n*) is "11", then the first transistor M1A would be turned on since the voltage VC2 is at (6V+Vth) higher than the voltage of the source line SLn. Therefore, the voltage VC1 will be adjusted to the fourth voltage V4 (6V), and the pixel circuit 100(*m,n*) is refreshed to the fourth data voltage V4 corresponding to the polarity voltage change of the common voltage line COMm.

However, if the image data stored in the pixel circuit 100(*m,n*) is "10", "01", or "00", then the first transistor M1A would not be turned on since the voltage VC2 is at (−6V) lower than the voltage of the source line SLn. Therefore, if the image data stored in the pixel circuit 100(*m,n*) is "10", "01", or "00", then the pixel circuit 100(*m,n*) will not be refreshed.

At time TB5, the voltage of second control line ENm is changed from the low voltage L to the high voltage H, turning on the second transistor M2A, then the voltage of the first control line CGm is changed from the first gate push voltage VGB1 to the reference voltage V0. Therefore, the pixel circuit 100(*m,n*) can enter the suspending status with the voltage VC2 to be (−6V). In some embodiments, the voltage of the first control line CGm can be changed to the reference voltage V0 between time TB5 and time TB6, i.e. the voltage of the first control line CGm can be changed to the reference voltage V0 at time TB5 or time TB6.

The second refreshing process FB2 has similar operations as the first refreshing process FB1. In the second refreshing process FB2, at time TB6, the voltage of third control line SHm is changed from the first intermediate voltage VIB1 to a second intermediate voltage VIB2. The second intermediate voltage VIB2 can be the second data voltage V2 minus the difference between the high polarity voltage VCH and the low polarity voltage VCL. In the present embodiment, the second intermediate voltage VIB2 can be (−4V).

In this case, if the image data stored in the pixel circuit 100(*m,n*) is "10", then the voltage VC1 and the voltage of the third control line SHm are both at (−4V). Therefore, the third transistor M3A will finally be turned off, and the voltage VC2 would be set to (−4V−Vth). However, if the image data stored in the pixel circuit 100(*m,n*) is "10", "01", or "00", then the voltage VC2 would be at (−4V) since the voltage VC1 would be higher than −4V and the third transistor M3A remains turned on.

At time TB7, the voltage of the first control line CGm is changed from the reference voltage V0 to a second gate push voltage VGB2. The second gate push voltage VGB2 is equal to the third data voltage V3 plus two times the threshold voltage Vth and minus the second intermediate voltage VIB2, which is (V3+2Vth−VIB2), or (8V+2Vth) in the present embodiment. In FIG. 8 at time TB7, if the image data stored in the pixel circuit 100(*m,n*) is "10", then the third transistor M3A is turned off so the voltage VC2 will be raised to (4V+Vth) as the voltage of the first control line CGm changes. Otherwise, the voltage VC2 will remain at (−4V).

Next, the voltage of the second control line ENm is changed from the high voltage H to the low voltage L, turning off the second transistor M2A. At time TB8, the voltage of source line SLn is changed from the fourth data voltage V4 to the third data voltage V3. In this case, if the image data stored in the pixel circuit 100(*m,n*) is "10", then the first transistor M1A would be turned on since the voltage VC2 is at (4V+Vth) higher than the voltage of the source line SLn. Therefore, the pixel circuit 100(*m,n*) is refreshed to store the third data voltage V3 corresponding to the polarity voltage change of the common voltage line COMm.

However, if the image data stored in the pixel circuit 100(*m,n*) is "10", "01", or "00", then the first transistor M1A would not be turned on, and the pixel circuit 100(*m,n*) will not be refreshed.

At time TB9, the voltage of second control line ENm is changed from the low voltage L to the high voltage H, turning on the second transistor M2A. Then, the voltage of the first control line CGm is changed from the second gate push voltage VGB2 to the reference voltage V0. Therefore, the pixel circuit 100(*m,n*) enters the suspending status again. In some embodiments, the voltage of the first control line CGm can be changed to the reference voltage V0 between time TB9 and time TB10, i.e. the voltage of the first control line CGm can be changed to the reference voltage V0 at time TB9 or time TB10.

The third refreshing processes FB3 has similar operations as the second refreshing process FB2. At time TB10, the voltage of third control line SHm is changed from the second intermediate voltage VIB2 to a third intermediate voltage VIB3. The third intermediate voltage VIB3 can be the third data voltage V3 minus the difference between the high polarity voltage VCH and the low polarity voltage VCL. In the present embodiment, the third intermediate voltage VIB3 can be (−2V).

In this case, if the image data stored in the pixel circuit 100(*m,n*) is "01", then the voltage VC2 would be charged (−2−Vth) and the third transistor M3A will finally turned off. Otherwise, the voltage VC2 of the second terminal be charged to (−2V) since the voltage VC1 would be higher than (−2V) and the third transistor M3A remains turned on.

At time TB11, the voltage of the first control line CGm is changed from the reference voltage V0 to a third gate push voltage VGB3. The third gate push voltage VGB3 can be set as the second data voltage V2 plus two times the threshold voltage Vth and minus the third intermediate voltage VIB3, which is (V2+2Vth−VIB3), or (4V+2Vth) in the present embodiment. In FIG. 8 at time TB11, if the image data stored in the pixel circuit 100(*m,n*) is "01", then the third transistor M3A is turned off so the voltage VC2 will be raised to (2V+Vth) as the voltage of the first control line CGm changes. Otherwise, the third transistor M3A is turned on, and the voltage VC2 will remain at (−2V).

Next, the voltage of the second control line ENm is changed from the high voltage H to the low voltage L, turning off the second transistor M2A. At time TB12, the voltage of source line SLn is changed from the third data voltage V3 to the second data voltage V2. In this case, the pixel circuit 100(*m,n*) storing image data of "01" is refreshed to store the second data voltage V2 corresponding to the polarity voltage change of the common voltage line COMm. However, the pixel circuit 100(*m,n*) storing image data of "11", "10", or "00" will not be refreshed.

At time TB13, the voltage of second control line ENm is changed from the low voltage L to the high voltage H, turning on the second transistor M2A. Then, the voltage of the first control line CGm is changed from the third gate push voltage VGB3 to the reference voltage V0. Therefore, the pixel circuit 100(*m,n*) enters the suspending status. In some embodiments, the voltage of the first control line CGm can be changed to the reference voltage V0 between time TB13 and time TB14, i.e. the voltage of the first control line CGm can be changed to the reference voltage V0 at time TB13 or time TB14.

In the fourth refreshing process FB4, at time TB14, the voltage of third control line SHm is changed from the third intermediate voltage VIB3 to a fourth intermediate voltage VIB4. The fourth intermediate voltage VIB4 can be the fourth data voltage V4 minus the difference between the high polarity voltage VCH and the low polarity voltage VCL. In the present embodiment, the fourth intermediate voltage VIB2 can be (0V).

In this case, if the image data stored in the pixel circuit 100(*m,n*) is "00", then the voltage VC2 would be charged (−Vth) and the third transistor M3A will finally be turned off. Otherwise, the voltage VC2 would be charged to (0V) since the voltage VC1 is higher than 0V and the third transistor M3A remains turned on.

At time TB15, the voltage of the first control line CGm is changed from the reference voltage V0 to a fourth gate push voltage VGB4. The fourth gate push voltage VGB4 can be set as the first data voltage V1 plus two times the threshold voltage Vth of the first transistor M1A and minus the fourth intermediate voltage VIB4, which is (V1+2Vth−VIB4), or (2Vth) in the present embodiment. In FIG. 8 at time TB15, if the image data stored in the pixel circuit 100(*m,n*) is "00", then the third transistor M3A is turned off so the voltage VC2 will be raised to Vth as the voltage of the first control line CGm changes. Otherwise, the third transistor M3A is turned on, and the voltage VC2 will remain at 0V.

Next, the voltage of the second control line ENm is changed from the high voltage H to the low voltage L, turning off the second transistor M2A. At time TB16, the voltage of source line SLn is changed from the second data voltage V2 to the first data voltage V1. In this case, the pixel circuit 100(*m,n*) storing image data of "00" is refreshed to store the first data voltage V1 corresponding to the polarity voltage change of the common voltage line COMm. However, the pixel circuit 100(*m,n*) storing image data of "11", "10", or "01" will not be refreshed.

Later, the voltage of second control line ENm is changed from the low voltage L to the high voltage H, turning on the second transistor M2A. At time TB17, the voltage of the third control line SHm is changed from the fourth intermediate voltage VIB4 to the low voltage L, and then the voltage of the first control line CGm is changed from the fourth gate push voltage VGB4 to the reference voltage V0, and the voltage of the source line SLn is changed from the first data voltage V1 to the reference voltage V0. Therefore, the pixel circuit 100(*m,n*) enters the suspending status. In FIG. 7, to distinguish the first data voltage V1 and the reference voltage V0, the voltage levels are depicted differently. However, in some embodiments, the first data voltage V1 and the reference voltage V0 can both be 0V as mentioned previously. In this case, the final voltage change of the source line SLn may be skipped. In addition, the voltage of the first control line CGm can be changed to the reference voltage V0 at time TB17 in some embodiments.

Consequently, after the four refreshing processes FB1 to FB4, pixel circuits storing images data "11", "10", "01", "00" can be refreshed respectively. Also, since the data voltage stored in the first capacitor C1A is sampled by the control terminal of the third transistors M3A at time TB2, TB6, TB10, and TB14 in FIGS. 7 and 8, the charges stored in the first capacitor C1A will not dissipate during the refreshing processes, reducing the flickers.

According to the timing diagram shown in FIGS. 5-8, the pixel circuits 100(1,1) to 100(M,N) can be refreshed when the common voltage lines COM1 to COMM change their polarity voltages. In some embodiments, the polarity voltage change may be applied to all pixel circuits 100(1,1) to 100(M,N) at the same time. In this case, the timing diagram shown in FIGS. 5-8 for the pixel circuits 100(*m,n*) can be applied to all the pixel circuits 100(1,1) to 100(M,N), meaning the control lines may be driven simultaneously with the same voltages. However, in some other embodiments, the polarity voltage change may be applied with different patterns. For example, pixel circuits in two adjacent rows may receive the different polarity voltages. In this case, each two rows of the pixel circuits may be refreshed by different refreshing process accordingly, and the control lines may be driven individually.

In addition, although in FIGS. 5 and 7, the voltages of the control lines are changed in different time points, however, in some embodiments, some of the voltages of the control lines may be changed at the same time if the operations can still be executed. In this case, the refreshing processes may be performed even faster.

Figure 9:
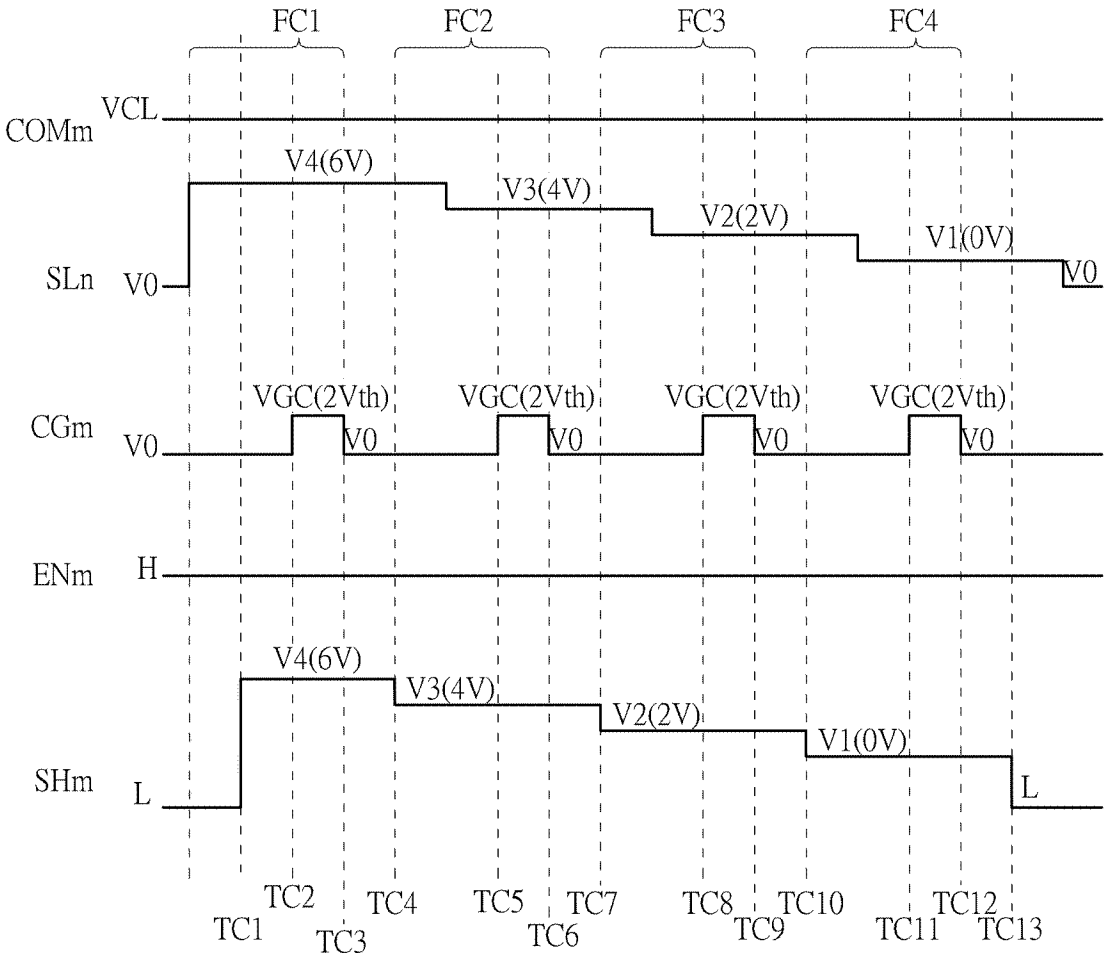
FIG. 9 shows a timing diagram of the signals received by the pixel circuit in FIG. 2 during the four refreshing processes with the common voltage line stays at the same polarity voltage.
Figure 10:
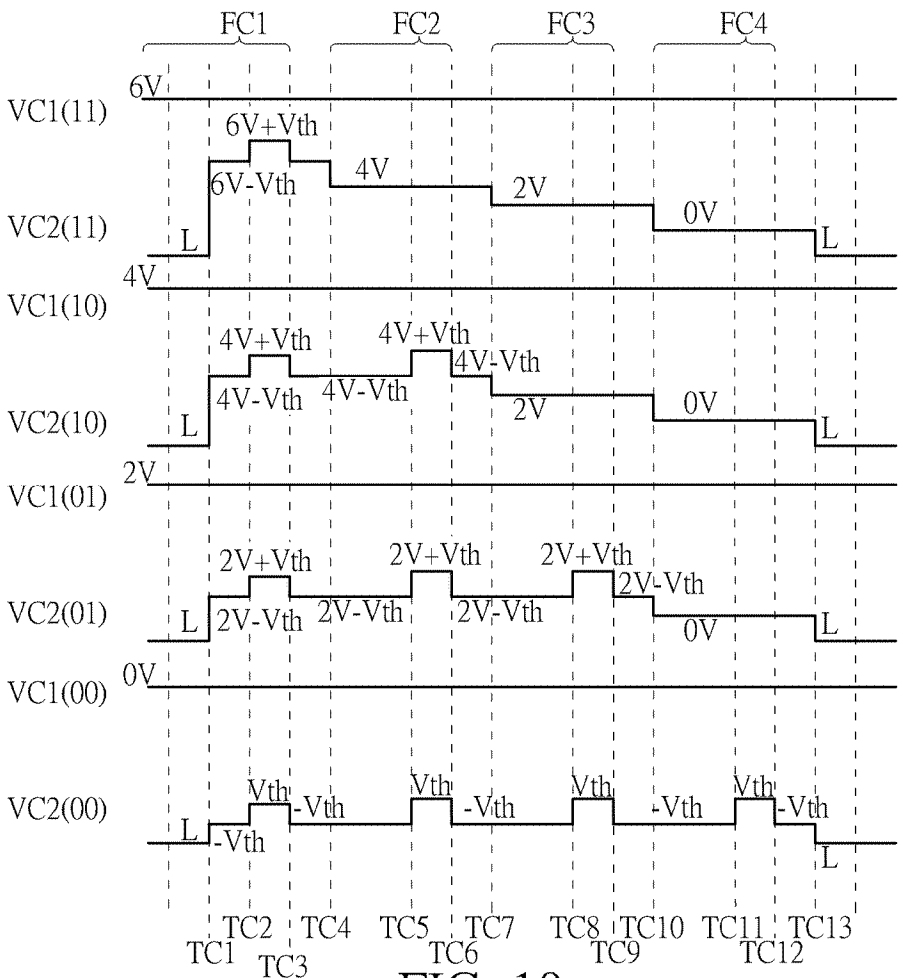
FIG. 10 shows the voltages of the first capacitor and the second capacitor with the image data being "11", "10", "01", and "00" according to the waveform shown in FIG. 9.

Also, in some embodiments, the pixel circuits 100(1,1) to 100(M,N) may be refreshed without changing polarity voltage. FIG. 9 shows a timing diagram of the signals received by the pixel circuit 100(*m,n*) during the four refreshing processes FC1 to FC4 with the common voltage line stays at the same polarity voltage VCL. FIG. 10 shows the voltages VC1 of the second terminal of the first capacitor C1A and the voltages VC2 of the second terminal of the second capacitor C2A with the image data stored in the pixel circuit 100(*m,n*) being "11", "10", "01", and "00" according to the waveform shown in FIG. 9.

In the beginning of the first refreshing process FC1 in FIG. 9, the pixel circuit 100(*m,n*) is in the suspending status with the corresponding image data being written previously. Then, the voltage of the source line SLn is changed from the reference voltage V0 to the fourth data voltage V4. At time TC1, the voltage of the third control line SHm is changed from the low voltage L to the fourth data voltage V4. In this case, the voltage VC2 will be charged to a sample voltage corresponding to the voltage VC1 of the second terminal of the first capacitor C1A.

For example, at time TC1 in FIG. 10, if the image data stored in the pixel circuit 100(*m,n*) is "11", then the voltage VC2 would be charged to (6V−Vth) when the third transistor M3A is finally turned off. Similarly, if the image data stored in the pixel circuit 100(*m,n*) is "10", then the voltage VC2 would be charged to (4V−Vth), if the image data stored in the pixel circuit 100(*m,n*) is "01", then the voltage VC2 would be charged to (2V−Vth), and if the image data stored in the pixel circuit 100(*m,n*) is "00", then the voltage VC2 would be charged to (−Vth).

At time TC2, the voltage of the first control line CGm is changed from the reference voltage V0 to a gate push voltage VGC. The gate push voltage VGC can be higher than the reference voltage V0 by two times the threshold voltage Vth of the first transistor M1A. Therefore, the voltage VC2 is raised accordingly as shown in FIG. 10.

In FIG. 10, if the image data stored in the pixel circuit 100(*m,n*) is "11", then the voltage VC2 would be raised to (6V+Vth), which is higher than the voltage of the source line SLn (6V), and the first transistor M1A would be turned on. Therefore, the voltage VC1 will be charged to the fourth data voltage V4, and the pixel circuit 100(*m,n*) storing image data of "11" is refreshed. However, if the image data stored in the pixel circuit 100(*m,n*) is "10", "01", or "00", the first transistor M1A will not be turned on, and the pixel circuit 100(*m,n*) will not be refreshed.

At time TC3, the voltage of the first control line CGm is changed from the gate push voltage VGC to the reference voltage V0, and the pixel circuit 100(*m,n*) is in the suspending status again.

In the second refreshing process FC2 in FIG. 9, the voltage of the third control line SHm is changed from the fourth data voltage V4 to the third data voltage V3 at time TC4. In this case, the voltage VC2 will be charged or discharged corresponding to the voltage VC1.

For example, at time TC4 in FIG. 10, if the image data stored in the pixel circuit 100(*m,n*) is "10", then the voltage VC2 would be set to (4V−Vth) when the third transistor M3A is finally turned off. Similarly, if the image data stored in the pixel circuit 100(*m,n*) is "01" or "00", then the voltage VC2 would be charged to (2V−Vth) or (−Vth) when the third transistor M3A is finally turned off. However, if the image data stored in the pixel circuit 100(*m,n*) is "11", then the voltage VC2 would be set to 4V since the voltage VC1 is higher than the voltage of the third control line SHm and the third transistor M3A remains turned on.

Next, the voltage of the source line SLn is changed from the fourth data voltage V4 to the third data voltage V3. At time TC5, the voltage of the first control line CGm is changed from the reference voltage V0 to the gate push voltage VGC, and the voltage VC2 is raised accordingly as shown in FIG. 10.

In FIG. 10, if the image data stored in the pixel circuit 100(*m,n*) is "10", then the voltage VC2 would be raised to (4V+Vth), which is higher than the voltage of the source line SLn (4V), and the first transistor M1A would be turned on. Therefore, the voltage VC1 will be charged to the third data voltage V3 (4V), and the pixel circuit 100(*m,n*) storing image data of "10" is refreshed. However, if the image data stored in the pixel circuit 100(*m,n*) is "11", "01", or "00", the first transistor M1A will not be turned on, and the pixel circuit 100(*m,n*) will not be refreshed.

At time TC6, the voltage of the first control line CGm is changed from the gate push voltage VGC to the reference voltage V0, and the pixel circuit 100(*m,n*) is in the suspending status again.

The third refreshing process FC3 has similar operations as the second refreshing process. At time TC7, the voltage of the third control line SHm is changed from the third data voltage V3 to the second data voltage V2, and the voltage VC2 will be charged corresponding to the voltage VC1.

Next, the voltage of the source line SLn is changed from the third data voltage V3 to the second data voltage V2. At time TC8, the voltage of the first control line CGm is changed from the reference voltage V0 to the gate push voltage VGC, and the voltage VC2 is raised accordingly as shown in FIG. 10.

At time TC8, if the image data stored in the pixel circuit 100(*m,n*) is "01", then the voltage VC2 would be raised to (2V+Vth), which is higher than the voltage of the source line SLn (2V), and the first transistor M1A would be turned on. Therefore, the voltage VC1 will be charged to the second data voltage V2 (2V), and the pixel circuit 100(*m,n*) storing image data of "01" is refreshed. However, if the image data stored in the pixel circuit 100(*m,n*) is "11", "10", or "00", the first transistor M1A will not be turned on, and the pixel circuit 100(*m,n*) will not be refreshed.

At time TC9, the voltage of the first control line CGm is changed from the gate push voltage VGC to the reference voltage V0, and the pixel circuit 100(*m,n*) is in the suspending status again.

The similar operations are also applied to the fourth refreshing process FC4. At time TC10, the voltage of the third control line SHm is changed from the second data voltage V2 to the first data voltage V1, and the voltage VC2 will be charged corresponding to the voltage VC1.

Next, the voltage of the source line SLn is changed from the second data voltage V2 to the first data voltage V1. At time TC11, the voltage of the first control line CGm is changed from the reference voltage V0 to the gate push voltage VGC, and the voltage VC2 is raised accordingly as shown in FIG. 10.

At time TC11, if the image data stored in the pixel circuit 100(*m,n*) is "00", then the voltage VC2 would be raised to (Vth), which is higher than the voltage of the source line SLn (0V), and the first transistor M1A would be turned on to refresh the pixel circuit 100(*m,n*). However, if the image data stored in the pixel circuit 100(*m,n*) is "11", "10", or "01", the first transistor M1A will not be turned on, and the pixel circuit 100(*m,n*) will not be refreshed.

At time TC12, the voltage of the first control line CGm is changed from the gate push voltage VGC to the reference voltage V0, and the voltage of the third control line SHm is changed from the reference voltage V0 to the low voltage L at time TC13. Finally, the pixel circuit 100(*m,n*) is back to the suspending status, and the voltage of the source line SLn is changed from the first data voltage V1 to the reference voltage V0. In FIG. 9, to distinguish the first data voltage V1 and the reference voltage V0, the voltage levels are depicted differently. However, in some embodiments, the first data voltage V1 and the reference voltage V0 can both be 0V as mentioned previously. In this case, the final voltage change of the source line SLn may be skipped. In addition, the voltage of the source line SLn can be changed to the reference voltage V0 at time TC13 in some embodiments.

Consequently, after the four refreshing processes FC1 to FC4, pixel circuits storing images data "11", "10", "01", "00" will be refreshed respectively. Also, since the data voltage stored in the first capacitor C1A is sampled by the control terminal of the third transistors M3A at time TC1, TC4, TC7, and TC10 in FIGS. 9 and 10, the charges stored in the first capacitor C1A will not dissipate during the refreshing processes, reducing the flickers.

In addition, although in FIG. 9, the voltages of the control lines are changed in different time points, however, in some embodiments, some of the voltages of the control lines may be changed at the same time if the operations can still be executed. In this case, the refreshing processes may be performed even faster.

Although operations of the display device 10 are mainly for 2-bit image data refreshment, the display device 10 may also support image data of other numbers of bits. For example, the display device 10 can support 1-bit image data in some embodiments. That is, the image data stored in the pixel circuit can be "1" or "0", and the corresponding data voltage can be, for example, the fourth voltage V4 and the first voltage V1. In this case, the timing diagram shown in FIG. 9 may also be applied for pixel circuits storing 1-bit of image data when the common voltage line stays at the same polarity voltage. For example, when refreshing the pixel circuit storing 1-bit of image data, the second refreshing process FC2 and the third refreshing process FC3 can be skipped, and the first refreshing process FC1 may refresh the pixel circuit storing image data "1" while the fourth refreshing process FC4 may refresh the pixel circuit storing image data "0".

Similarly, the timing diagram shown in FIGS. 5 and 7 may also be applied for the pixel circuit storing 1-bit of image data with proper adjustments if the polarity voltage changes. However, the pixel circuit storing 1-bit of image data may also be refreshed by other processes.

Figure 11:
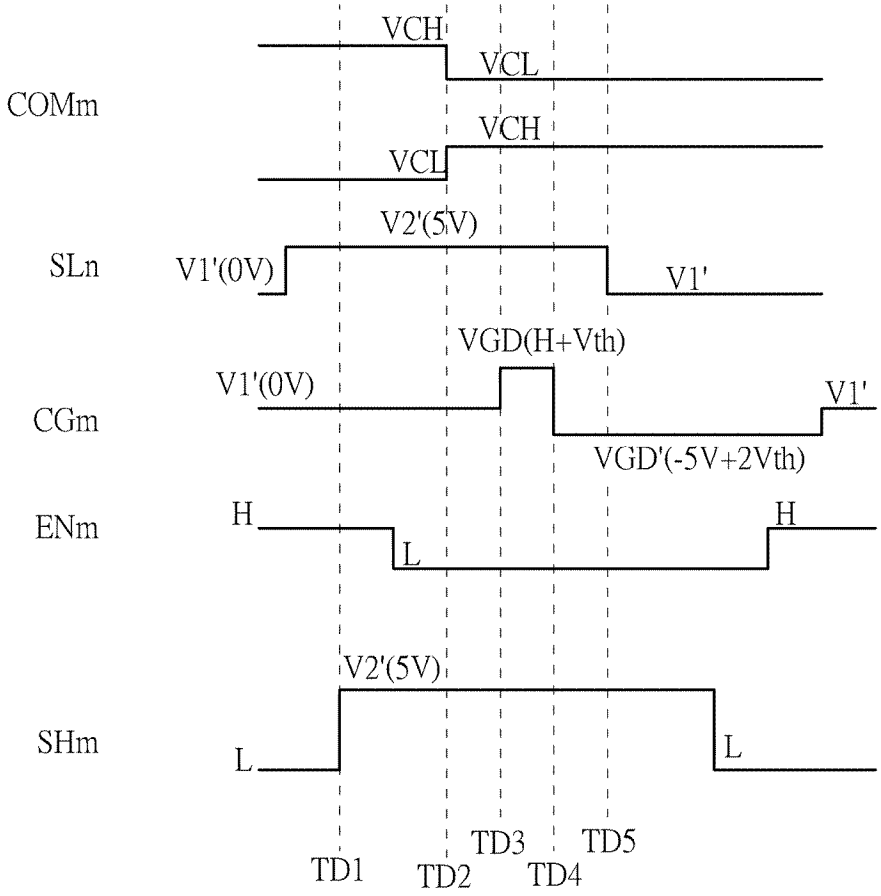
FIG. 11 shows a timing diagram of the signals received by the pixel circuit in FIG. 2 during the refreshing process with the common voltage line changing from the low polarity voltage to the high polarity voltage.
Figure 12:
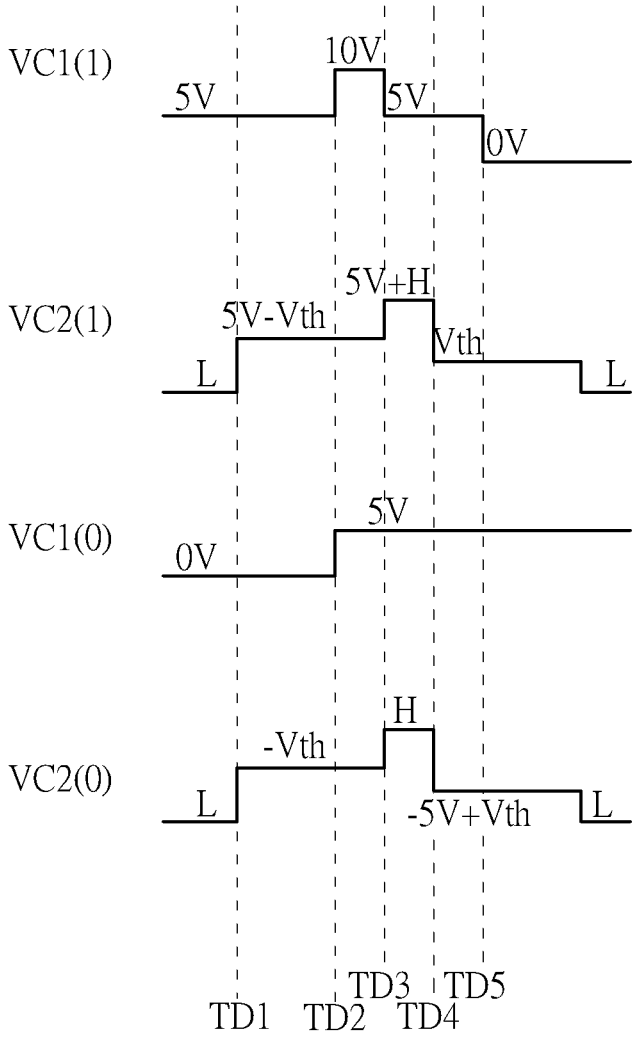
FIG. 12 shows the voltages of the first capacitor and the second capacitor with the image data being "1" and "0" according to the waveform shown in FIG. 11.

FIG. 11 shows a timing diagram of the signals received by the pixel circuit 100(*m,n*) during the refreshing process with the common voltage line COMm changing from the low polarity voltage VCL to the high polarity voltage VCH. FIG. 12 shows the voltages VC1 of the second terminal of the first capacitor C1A and the voltages VC2 of the second terminal of the second capacitor C2A with the image data stored in the pixel circuit 100(*m,n*) being "1" and "0" according to the waveform shown in FIG. 11. In the present embodiment, the image data "1" and "0" stored in the pixel circuit 100(*m,n*) can be corresponding to the second voltage V2' and the first voltage V1'. The first data voltage V1' can be 0V, and the second data voltage V2' can be 5V.

In FIG. 11, in the beginning of the refreshing process, the pixel circuit 100(*m,n*) is at the suspending status with the common voltage line COMm at the low polarity voltage VCL. Then, the voltage of the source line SLn is changed from the first data voltage V1' to the second data voltage V2'.

At time TD1, the voltage of the third control line SHm is changed from a low voltage L to the second data voltage V2'. The voltage VC2 is charged to a sample voltage according to the voltage VC1.

For example, at time TD1 in FIG. 12, if the image data stored in the pixel circuit 100(*m,n*) is "1", then the voltage VC2 would be charged to (5V−Vth) when the third transistor M3A is finally turned off. Similarly, if the image data stored in the pixel circuit 100(*m,n*) is "0", then the voltage VC2 would be charged to (−Vth) when the third transistor M3A is finally turned off.

Next, the voltage of the second control line ENm is changed from the high voltage H to the low voltage L, turning off the second transistor M2A. At time TD2, the voltage of the common voltage line COMm is changed from the low polarity voltage VCL to the high polarity voltage VCH. Therefore, the voltage VC1 is raised accordingly as shown in FIG. 12.

At time TD3, the voltage of the first control line CGm is changed from the first data voltage V1' to a gate push voltage VGD. The gate push voltage VGD can be higher than the high voltage H by the threshold voltage of the first transistor M1A, that is, (H+Vth). In this case, the voltage VC2 is further raised, so the first transistor M1A is turned on, and the voltage VC1 would be set to the second voltage V2' by the source line SLn. That is, the pixel circuit 100(*m,n*) storing the image data "0" is refreshed.

At time TD4, the voltage of the first control line CGm is changed from the gate push voltage VGD to a gate pull voltage VGD'. The gate pull voltage VGD' can be lower than the first data voltage V1' by the second data voltage V2' minus two times the threshold voltage Vth, that is, (V1'−V2'+2Vth), resulting in (−5V+2Vth). The voltage VC2 is also changed accordingly as shown in FIG. 12, and the first transistor M1A is turned off.

At time TD5, the voltage of the source line SLn is changed from the second data voltage V2' to the first data voltage V1'. If the pixel circuit 100(*m,n*) stores image data "1", then the voltage VC2 would be at the threshold voltage Vth at time TD5 as shown in FIG. 12. Therefore, the first transistor M1A is turned on, and the voltage VC1 would be set to the first data voltage V1' as the source line SLn. That is, the pixel circuit 100(*m,n*) storing the image data "1" is refreshed. However, If the pixel circuit 100(*m,n*) stores image data "0", then the voltage VC2 would be at (−5V+Vth) at time TD5 as shown in FIG. 12. Therefore, the first transistor M1A is turned off, and the pixel circuit 100(*m,n*) refreshed previously will not be refreshed at time TD5.

After the pixel circuit 100(*m,n*) is refreshed, the voltage of the third control line SHm is changed from the second data voltage V2' to the low voltage L, the voltage of the second control line ENm is changed from the low voltage L to the high voltage H, and the voltage of the first control line CGm is changed from the gate pull voltage VGD' to the first data voltage V1'. Consequently, the pixel circuit 100(*m,n*) is back to the suspending status.

With the refreshing process shown in FIG. 11, the pixel circuit 100(*m,n*) can be refreshed even faster than using the refreshing processes shown in FIGS. 5 and 7. Also, since the data voltage is sampled by the control terminal of the third transistor M3A, the charges stored in the first capacitor will not dissipate, reducing the flickers. Furthermore, in FIG. 10, the voltage of the common voltage line COMm is changed from the low polarity voltage VCL to the high polarity voltage VCH, however, the same operations shown in FIG. 10 can also be applied to the case that the voltage of the common voltage line COMm is changed from the high polarity voltage VCH to the low polarity voltage VCL.

In addition, at time TD3 in FIG. 11, the voltage of the pixel circuit storing image data "1" may also be refreshed as the voltage of the pixel circuit storing image data "0". However, the voltage of the pixel circuit storing image data "1" will be refreshed to the correct voltage (0V) later at time TD5. Since the refreshing time can be rather short, the mischarge of the pixel circuit will not be noticed.

Figure 13:
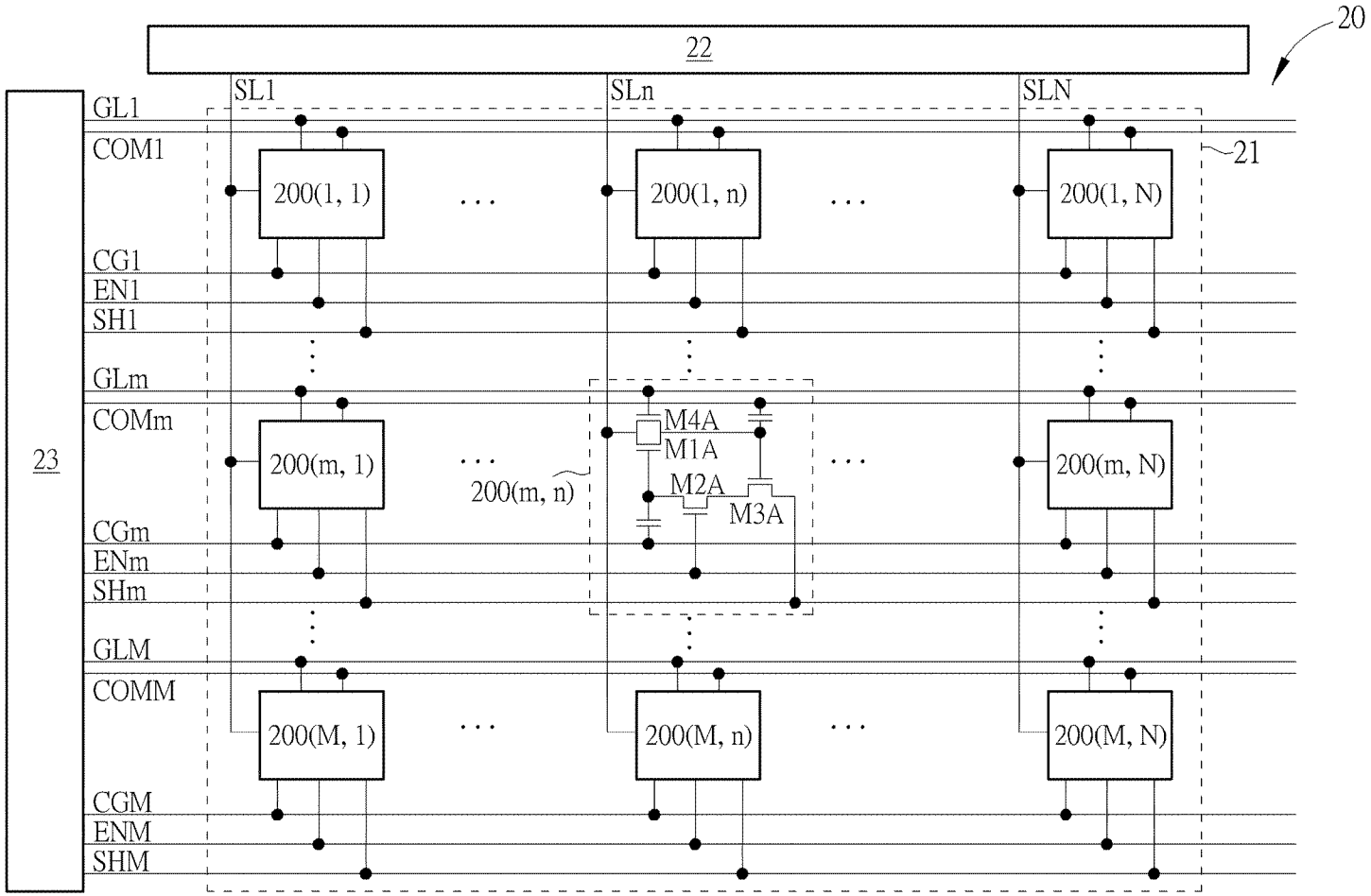
FIG. 13 shows a display device according to another embodiment of the present disclosure.

FIG. 13 shows a display device 20 according to another embodiment of the present disclosure. The display device 20 has a similar structure as the display device 20, and can be operated by similar principles. The display device 20 includes a pixel array 21, a source driver 22, and a control driver 23.

The pixel array 21 includes N source lines SL1 to SLN, M common voltage lines COM1 to COMM, M first control lines CG1 to CGM, M second control lines EN1 to ENM, M third control lines SH1 to SHM, M gate lines GL1 to GLM, and M×N pixel circuits 200(1,1) to 200(M,N) arranged in a matrix. As is made as an example, block diagram of the pixel circuit 200(*m,n*) is further shown in FIG. 13.

The pixel circuit 200(*m,n*) has a similar structure as the pixel circuit 100(*m,n*); however, the pixel circuit 200(*m,n*) further includes a fourth transistor M4A. The fourth transistor M4A has a first terminal, a second terminal, and a control terminal. The first terminal of the fourth transistor M4A is coupled to the first terminal of the first transistor M1A, the second terminal of the fourth transistor M4A is coupled to the second terminal of the first transistor M1A, and the control terminal of the fourth transistor M4A is coupled to the gate line GLm. Since the fourth transistor M4A can be coupled to the gate line GLm and the source line SLn, the fourth transistor M4A can be used to control the data voltage received by the pixel circuit, simplifying the write process of the pixel circuit 200(*m,n*).

Figure 14:
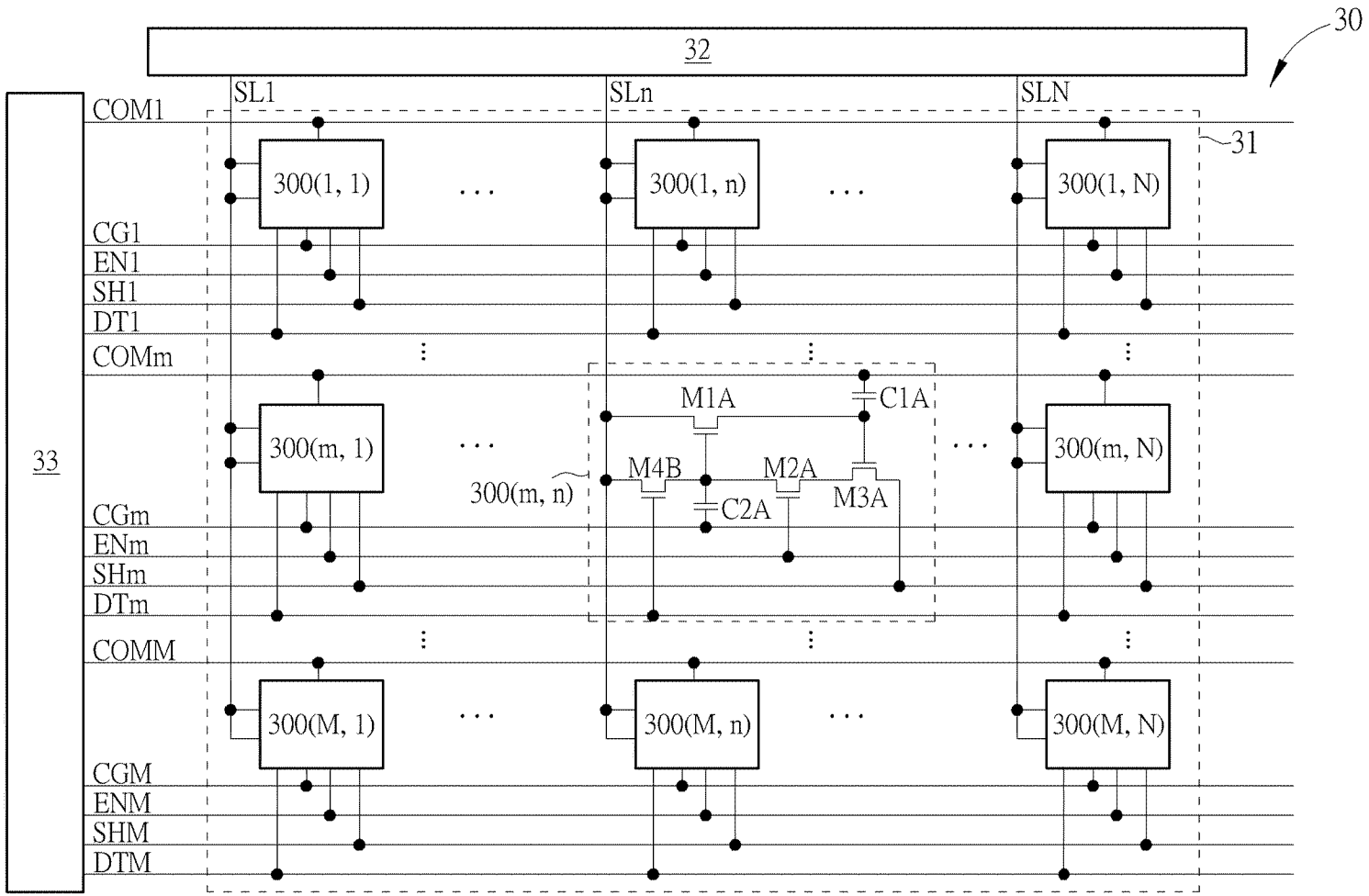
FIG. 14 shows a display device according to another embodiment of the present disclosure.

FIG. 14 shows a display device 30 according to another embodiment of the present disclosure. The display device 30 has a similar structure as the display device 10, and can be operated by similar principles. The display device 30 includes a pixel array 31, a source driver 32, and a control driver 33.

The pixel array 31 includes N source lines SL1 to SLN, M common voltage lines COM1 to COMM, M first control lines CG1 to CGM, M second control lines EN1 to ENM, M third control lines SH1 to SHM, M fourth control lines DT1 to DTM, and M×N pixel circuits 300(1,1) to 300(M,N) arranged in a matrix. As is made as an example, block diagram of the pixel circuit 300(*m,n*) is further shown in FIG. 14.

The pixel circuit 300(*m,n*) has a similar structure as the pixel circuit 100(*m,n*); however, the pixel circuit 300(*m,n*) further includes a fourth transistor M4B. The fourth transistor M4B has a first terminal, a second terminal, and a control terminal. The first terminal of the fourth transistor M4B is coupled to the source line SLn, the second terminal of the fourth transistor M4B is coupled to the first terminal of the second transistor M2A, and the control terminal of the fourth transistor M4B is coupled to the fourth control line DTm. Since the fourth transistor M4B can be coupled to the second capacitor C2A and the source line SLn, the fourth transistor M4B can be used to control the voltage received by the second capacitor C2A, simplifying the initialization process of the pixel circuit 300(*m,n*).

Figure 15:
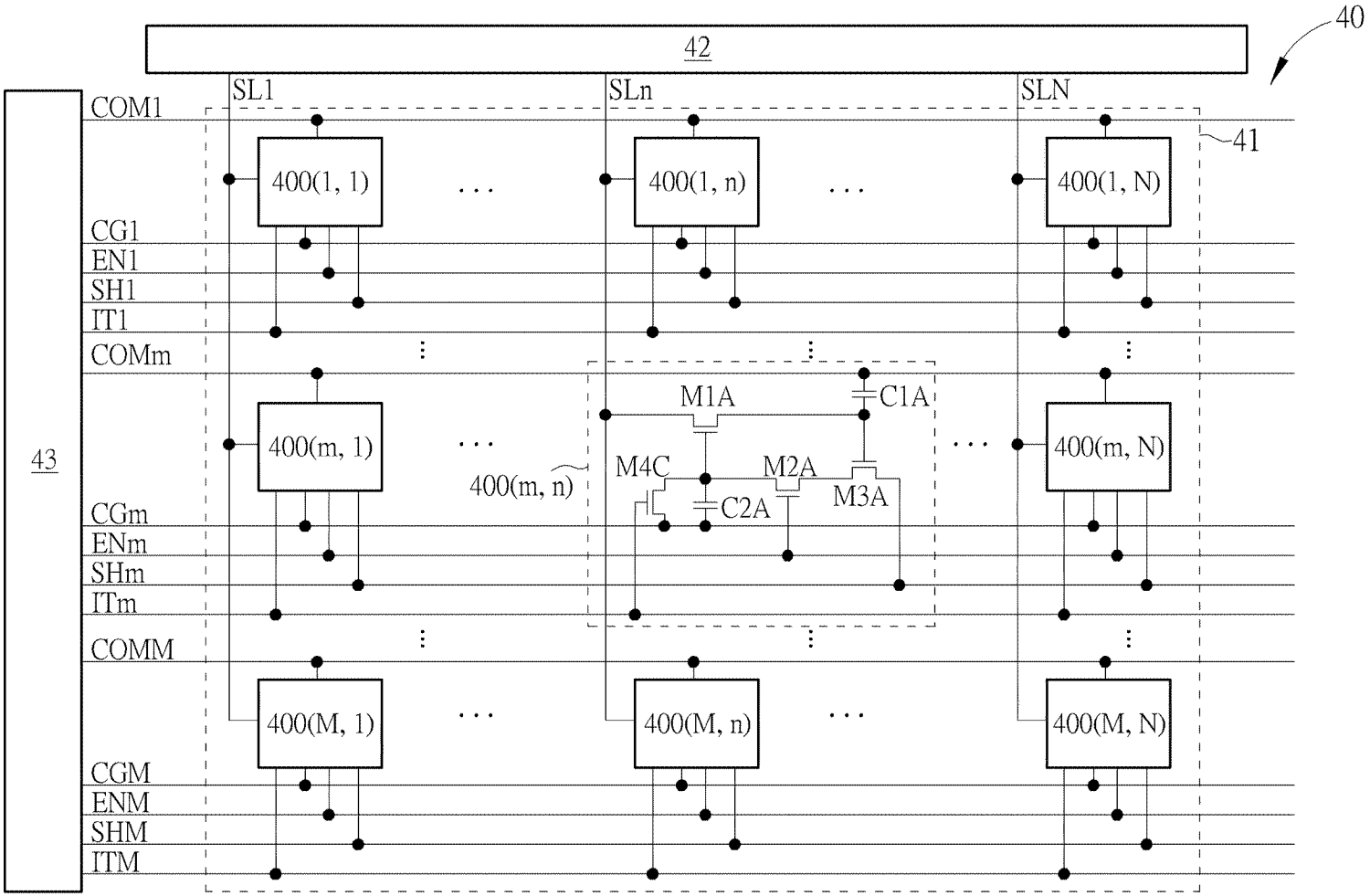
FIG. 15 shows a display device according to another embodiment of the present disclosure.

FIG. 15 shows a display device 40 according to another embodiment of the present disclosure. The display device 40 has a similar structure as the display device 10, and can be operated by similar principles. The display device 40 includes a pixel array 41, a source driver 42, and a control driver 43.

The pixel array 41 includes N source lines SL1 to SLN, M common voltage lines COM1 to COMM, M first control lines CG1 to CGM, M second control lines EN1 to ENM, M third control lines SH1 to SHM, M fourth control lines IT1 to ITM, and M×N pixel circuits 400(1,1) to 400(M,N) arranged in a matrix. As is made as an example, block diagram of the pixel circuit 400(*m,n*) is further shown in FIG. 15.

The pixel circuit 400(*m,n*) has a similar structure as the pixel circuit 100(*m,n*); however, the pixel circuit 400(*m,n*) further includes a fourth transistor M4C. The fourth transistor M4C has a first terminal, a second terminal, and a control terminal. The first terminal of the fourth transistor M4C is coupled to the first control line CGm, the second terminal of the fourth transistor M4C is coupled to the first terminal of the second transistor M2A, and the control terminal of the fourth transistor M4C is coupled to the fourth control line ITm. Since the fourth transistor M4C can be coupled to the second capacitor C2A and the first control line CGm, the fourth transistor M4C can be used to control the voltage received by the second capacitor C2A, simplifying the control of the first transistor M1A.

Figure 16:
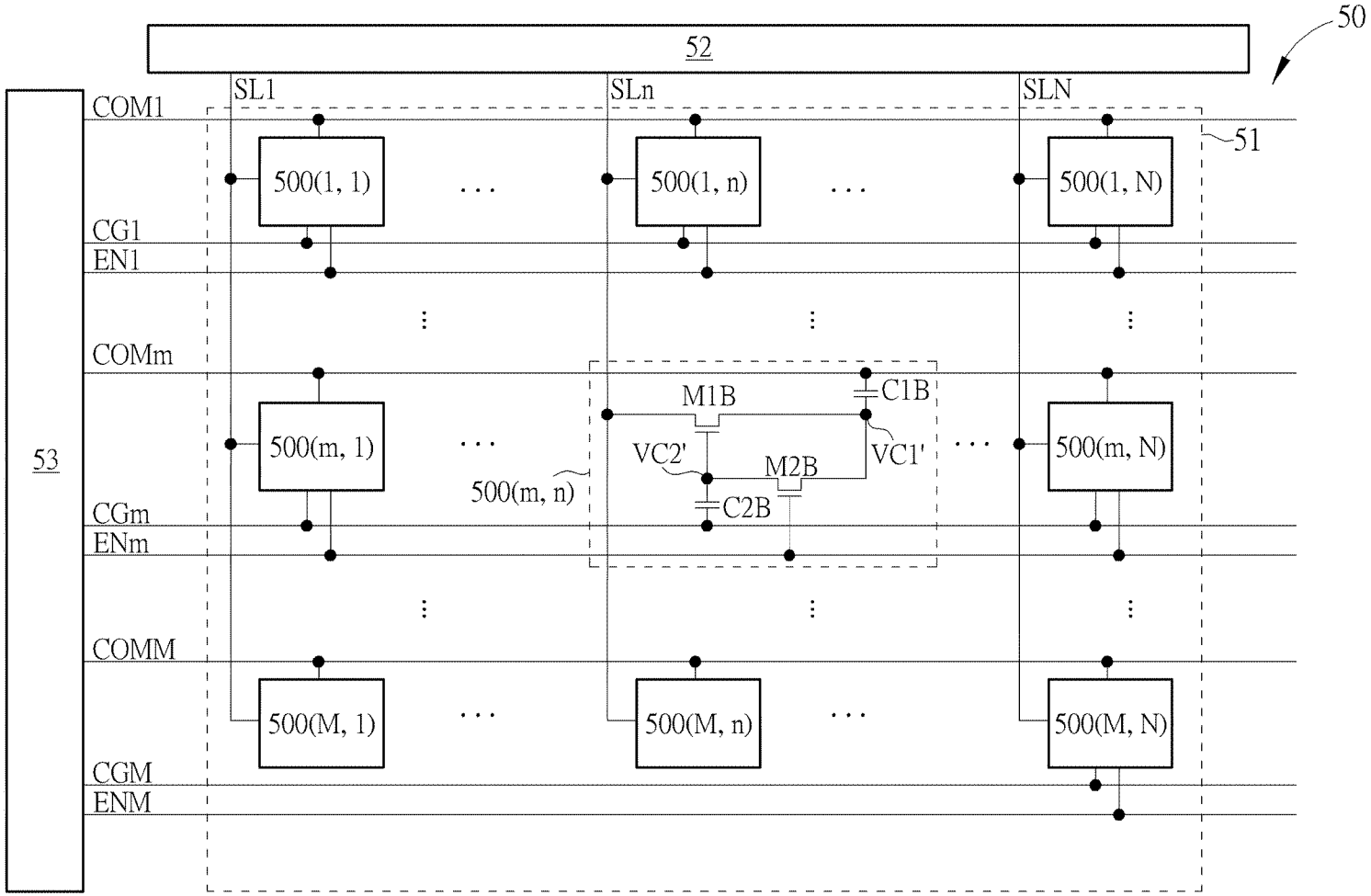
FIG. 16 shows a display device according to another embodiment of the present disclosure.

FIG. 16 shows a display device 50 according to another embodiment of the present disclosure. The display device 50 includes a pixel array 51, a source driver 52, and a control driver 53.

The pixel array 51 includes N source lines SL1 to SLN, M common voltage lines COM1 to COMM, M first control lines CG1 to CGM, M second control lines EN1 to ENM, and M×N pixel circuits 500(1,1) to 500(M,N) arranged in a matrix. As is made as an example, block diagram of the pixel circuit 500(*m,n*) is further shown in FIG. 16. The source driver 52 can drive the source lines SL1 to SLN, and the control driver 53 can drive the first control lines CG1 to CGM, and the second control lines EN1 to ENM.

The pixel circuit 500(*m,n*) includes a first capacitor C1B, a second capacitor C2B, a first transistor M1B, a second transistor M2B.

The first capacitor C1B has a first terminal and a second terminal. The first terminal of the first capacitor C1B is coupled to the common voltage line COMm. The second capacitor C2B has a first terminal and a second terminal. The first terminal of the second capacitor C2B is coupled to the first control line CGm.

The first transistor M1B has a first terminal, a second terminal, and a control terminal. The first terminal of the first transistor M1B is coupled to the source line SLn, the second terminal of the first transistor M1B is coupled to the second terminal of the first capacitor C1B, and the control terminal of the first transistor M1B is coupled to the second terminal of the second capacitor C2B. The second transistor M2B has a first terminal, a second terminal, and a control terminal. The first terminal of the second transistor M2B is coupled to the control terminal of the first transistor M1B, the second terminal of the second transistor M2B is coupled to the second terminal of the first capacitor C1B, and the control terminal of the second transistor M2B is coupled to the second control line ENm.

Figure 17:
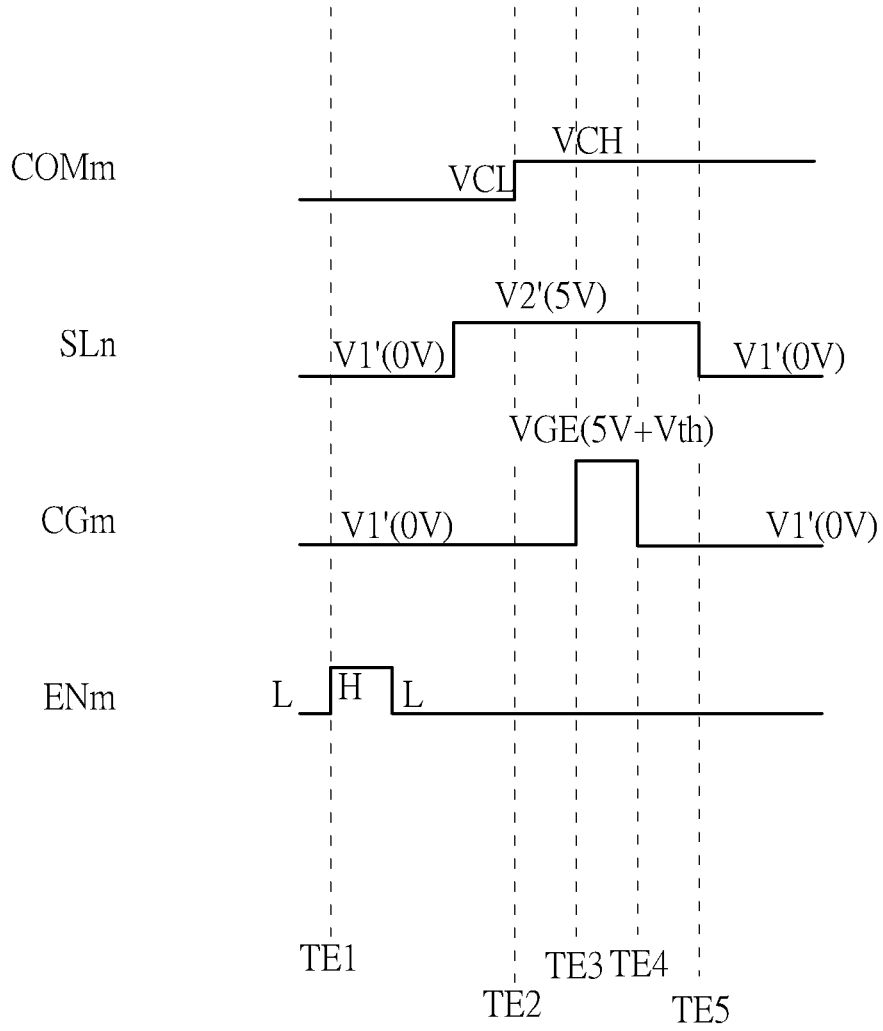
FIG. 17 shows a timing diagram of the signals received by the pixel circuit in FIG. 16 during the refreshing process with the common voltage line changing from the low polarity voltage to the high polarity voltage.
Figure 18:
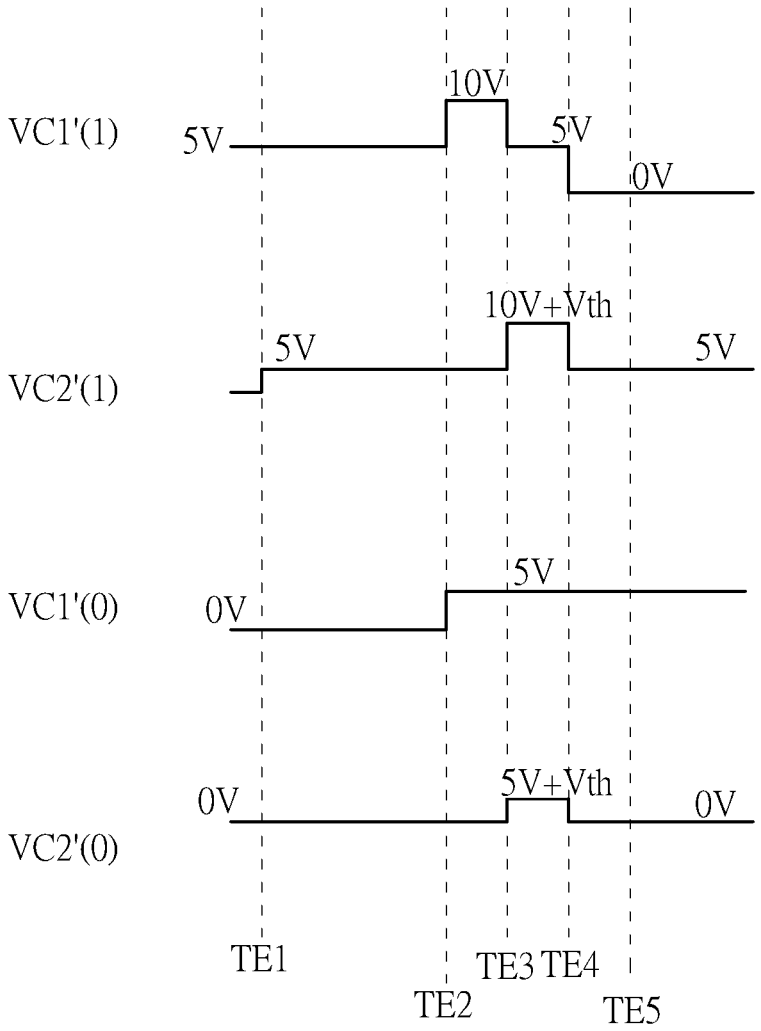
FIG. 18 shows the voltages of the first capacitor and the second capacitor with the image data being "1" and "0" according to the waveform shown in FIG. 17.

FIG. 17 shows a timing diagram of the signals received by the pixel circuit 500(*m,n*) during the refreshing process with the common voltage line COMm changing from the low polarity voltage VCL to the high polarity voltage VCH. FIG. 18 shows the voltages VC1' of the second terminal of the first capacitor C1B and the voltages VC2' of the second terminal of the second capacitor C2B with the image data stored in the pixel circuit 500(*m,n*) being "1" and "0" according to the waveform shown in FIG. 17.

In FIG. 17, in the beginning of the refreshing process, the pixel circuit 500(*m,n*) is at the suspending status with the common voltage line COMm at the low polarity voltage VCL and the source line SLn at the first data voltage V1'. In this case, the first capacitor C1B may store the first data voltage V1' as the image data "0", and may store the second data voltage V2' as the image data "1". Also, in the present embodiment, the first data voltage V1' can be 0V, and the second data voltage V2' can be 5V.

At time TE1, the voltage of the second control line ENm is changed from the low voltage L to the high voltage H, turning on the second transistor M2B. Therefore, the voltage VC2' is charged to a sample voltage according to the voltage VC1'.

For example, in FIG. 18, if the image data stored in the pixel circuit 500(*m,n*) is "1", then the voltage VC2' would be charged to 5V. If the image data stored in the pixel circuit 500(*m,n*) is "0", then the voltage VC2' would be charged to 0V.

Later, the voltage of the source line SLn is changed from the first data voltage V1' to the second data voltage V2'. At time TE2, the voltage of the common voltage line COMm is changed from the low polarity voltage VCL to the high polarity voltage VCH. Therefore, the voltage VC1' is raised accordingly as shown in FIG. 18.

At time TE3, the voltage of the first control line CGm is changed from the first data voltage V1' to a gate push voltage VGE. The gate push voltage VGE can be the second data voltage V2' plus the threshold voltage of the first transistor M1B, that is, (V2'+Vth). In this case, the voltage VC2' is raised to (10V+Vth) or (5V+Vth) according to the stored image data as shown in FIG. 18. However, in either cases, the first transistor M1B will be turned on, and the voltage VC1' will be charged to the second data voltage V2' as the source line SLn. Consequently, the voltage of the pixel circuit 500(*m,n*) storing image data "0" can be refreshed corresponding to the polarity voltage change.

At time TE4, the voltage of the first control line CGm is changed from the gate push voltage VGE to the first data voltage V1'. In this case, the voltage VC2' of the second terminal of the second capacitor C2 is dropped to 5V or 0V according to the stored image data as shown in FIG. 18.

At time TE5, the voltage of the source line SLn is changed from the second data voltage V2' to the first data voltage V1'. In this case, if the image data stored in the pixel circuit 500(*m,n*) is "1", then the VC2' would be at 5V, higher than the voltage of the source line SLn, which is at the first data voltage V1'. Therefore, the first transistor M1B is turned on, and the voltage VC1' will be changed to the first data voltage V1'. Consequently, the pixel circuit 500(*m,n*) storing image data "1" is refreshed corresponding to the polarity voltage change.

However, if the image data stored in the pixel circuit 500(*m,n*) is "0", then the VC2' would be at 0V, lower than the voltage VC1', which is at 5V. Therefore, the pixel circuit 500(*m,n*) storing image data "0" will not be refreshed.

According to the timing diagram shown in FIG. 17 and FIG. 18, the pixel circuit 500(*m,n*) can be refreshed while the polarity voltage changes from the low polarity voltage VCL to the high polarity voltage VCH. Also, the same operations shown in FIG. 17 can also be applied for refreshment when the polarity voltage changes from the high polarity voltage VCH to the low polarity voltage VCL.

Furthermore, in FIG. 17, the voltage of the common voltage line COMm is changed from the low polarity voltage VCL to the high polarity voltage VCH; however, the same operations shown in FIG. 17 can also be applied to the case that the voltage of the common voltage line COMm is changed from the high polarity voltage VCH to the low polarity voltage VCL.

Figure 19:
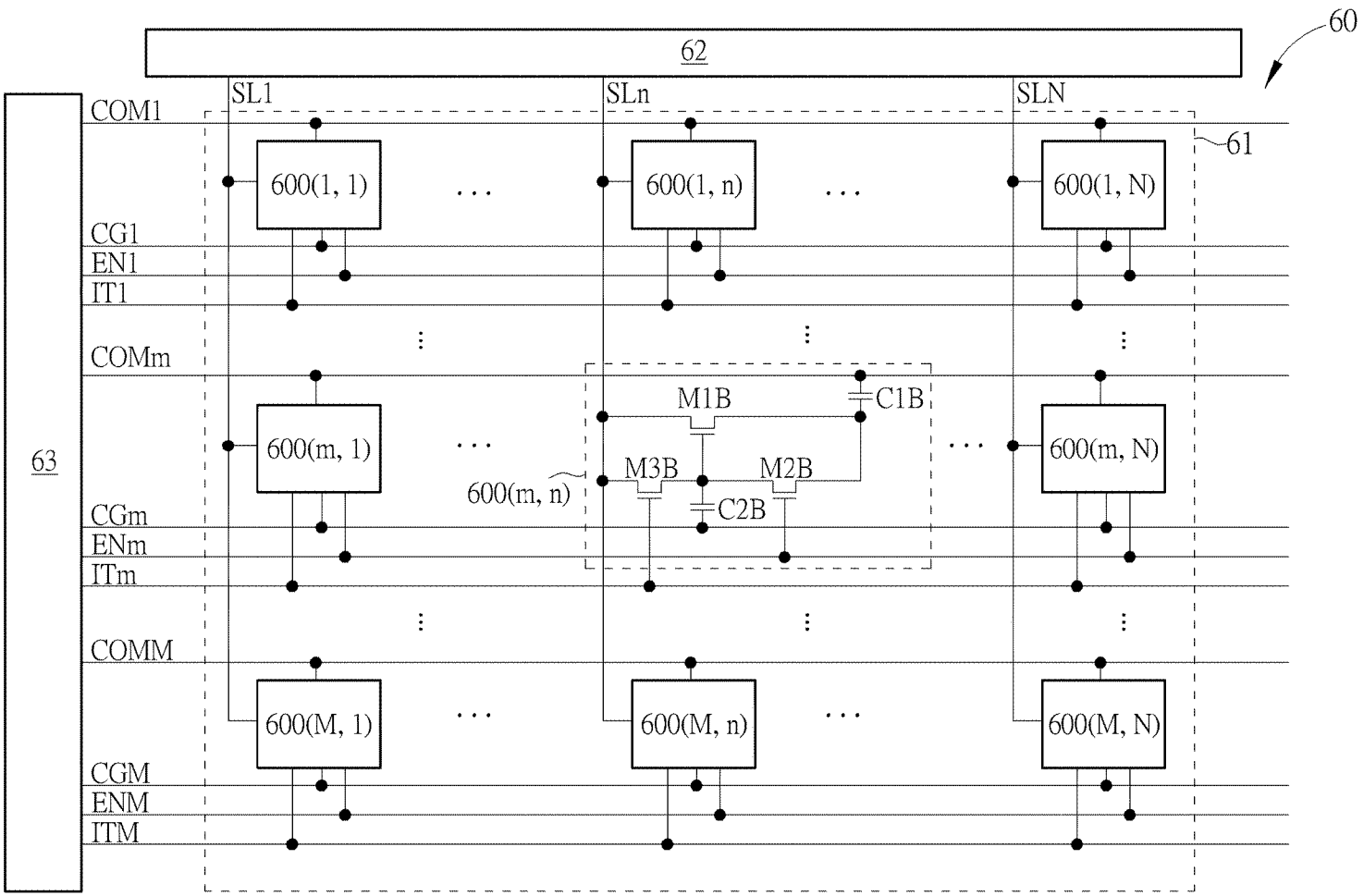
FIG. 19 shows a display device according to another embodiment of the present disclosure.

FIG. 19 shows a display device 60 according to another embodiment of the present disclosure. The display device 60 has a similar structure as the display device 50, and can be operated by similar principles. The display device 60 includes a pixel array 61, a source driver 62, and a control driver 63.

The pixel array 61 includes N source lines SL1 to SLN, M common voltage lines COM1 to COMM, M first control lines CG1 to CGM, M second control lines EN1 to ENM, M fourth control lines IT1 to ITM, and M×N pixel circuits 600(1,1) to 600(M,N) arranged in a matrix. As is made as an example, block diagram of the pixel circuit 600(*m,n*) is further shown in FIG. 19.

The pixel circuit 600(*m,n*) has a similar structure as the pixel circuit 500(*m,n*); however, the pixel circuit 600(*m,n*) further includes a third transistor M3B. The third transistor M3B has a first terminal, a second terminal, and a control terminal. The first terminal of the third transistor M3B is coupled to the source line SLn, the second terminal of the third transistor M3B is coupled to the second terminal of the second capacitor C2B, and the control terminal of the third transistor M3B is coupled to the fourth control line ITm. Since the third transistor M3B can be coupled to the second capacitor C2B and the source line SLn, the third transistor M3B can be used to control the voltage received by the second capacitor C2B, simplifying the initialization process.

Figure 20:
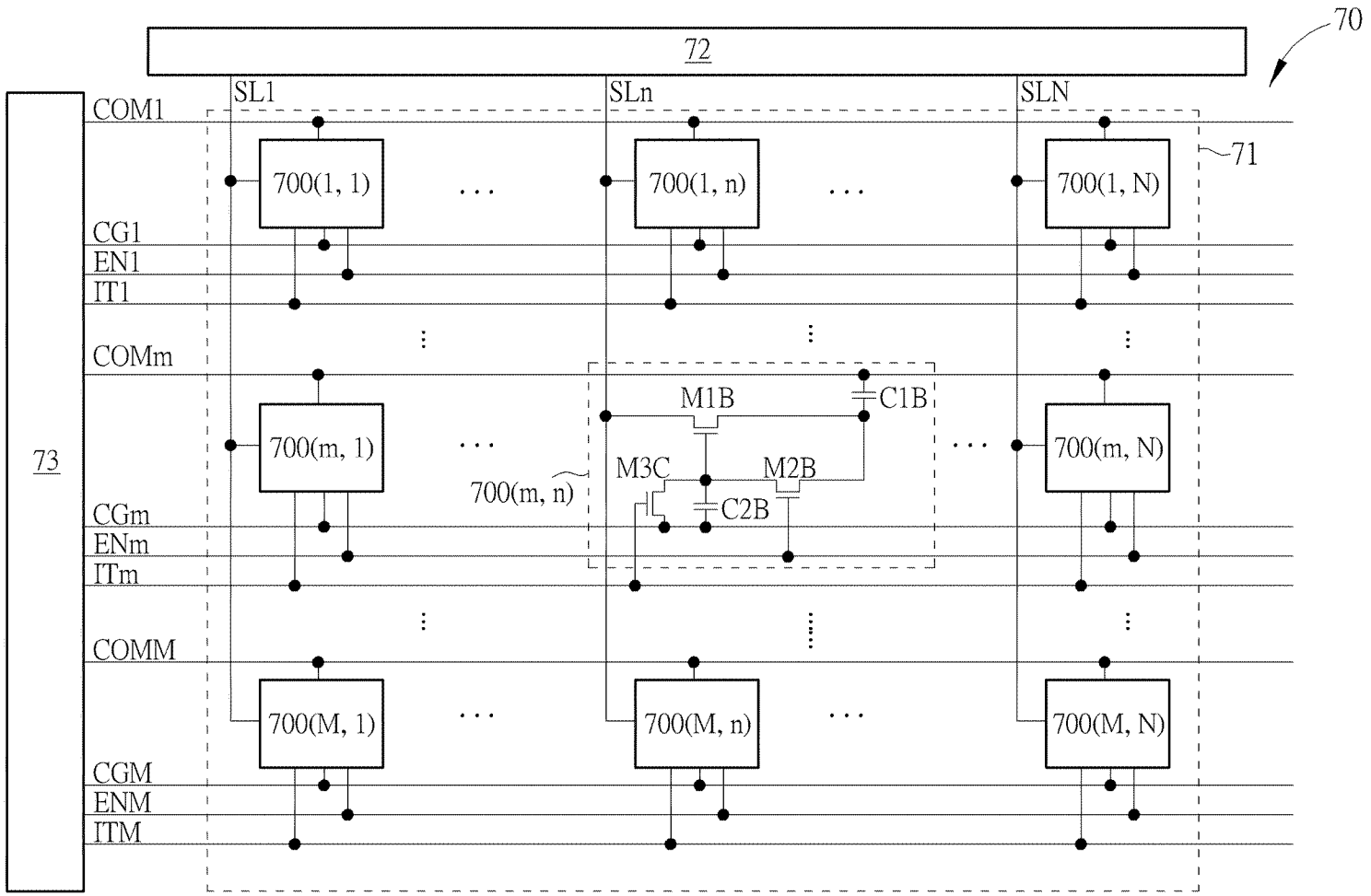
FIG. 20 shows a display device according to another embodiment of the present disclosure.

FIG. 20 shows a display device 70 according to another embodiment of the present disclosure. The display device 70 has a similar structure as the display device 50, and can be operated by similar principles. The display device 70 includes a pixel array 71, a source driver 72, and a control driver 73.

The pixel array 71 includes N source lines SL1 to SLN, M common voltage lines COM1 to COMM, M first control lines CG1 to CGM, M second control lines EN1 to ENM, M fourth control lines IT1 to ITM, and M×N pixel circuits 700(1,1) to 700(M,N) arranged in a matrix. As is made as an example, block diagram of the pixel circuit 700(*m,n*) is further shown in FIG. 20.

The pixel circuit 700(*m,n*) has a similar structure as the pixel circuit 500(*m,n*); however, the pixel circuit 700(*m,n*) further includes a third transistor M3C. The third transistor M3C has a first terminal, a second terminal, and a control terminal. The first terminal of the third transistor M3C is coupled to the second terminal of the second capacitor C2B, the second terminal of the third transistor M3C is coupled to the first control line CGm, and the control terminal of the third transistor M3C is coupled to the fourth control line ITm. Since the third transistor M3C can be coupled to the second capacitor C2B and the first control line CGm, the third transistor M3C can be used to control the voltage received by the second capacitor C2B, simplifying the initialization process.

In summary, the display devices and the pixel circuits provided by the embodiments of the present disclosure can store the image data and perform the refreshing processes with a smaller area than the prior art. Also, in some embodiments, since the data voltage received by the capacitor can be sampled by the control terminal of the third transistor, the charges stored in the capacitor will not dissipate during the refreshing processes, reducing flickers.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A display device, comprising:

a pixel array comprising:

a source line;

a common voltage line;

a first control line;

a second control line;

a third control line; and a pixel circuit comprising:

a first capacitor having a first terminal and a second terminal, wherein the first terminal of the first capacitor is coupled to the common voltage line;

a second capacitor having a first terminal and a second terminal, wherein the first terminal of the second capacitor is coupled to the first control line;

a first transistor having a first terminal, a second terminal, and a control terminal, wherein the first terminal of the first transistor is coupled to the source line, the second terminal of the first transistor is coupled to the second terminal of the first capacitor, and the control terminal of the first transistor is coupled to the second terminal of the second capacitor;

a second transistor having a first terminal, a second terminal, and a control terminal, wherein the first terminal of the second transistor is coupled to the control terminal of the first transistor, and the control terminal of the second transistor is coupled to the second control line; and a third transistor having a first terminal, a second terminal, and a control terminal, wherein the first terminal of the third transistor is coupled to the second terminal of the second transistor, the second terminal of the third transistor is coupled to the third control line, and the control terminal of the third transistor is coupled to the second terminal of the first transistor;

a source driver configured to drive the source line; and a control driver configured to drive the first control line, the second control line, and the third control line.

2. The display device of claim 1, further comprising:

a gate line;

wherein the pixel circuit further comprises:

a fourth transistor having a first terminal, a second terminal, and a control terminal, wherein the first terminal of the fourth transistor is coupled to the first terminal of the first transistor, the second terminal of the fourth transistor is coupled to the second terminal of the first transistor, and the control terminal of the fourth transistor is coupled to the gate line.

3. The display device of claim 1, further comprising:

a fourth control line;

wherein the pixel circuit further comprises:

a fourth transistor having a first terminal, a second terminal, and a control terminal, wherein the first terminal of the fourth transistor is coupled to the source line, the second terminal of the fourth transistor is coupled to the first terminal of the second transistor, and the control terminal of the fourth transistor is coupled to the fourth control line.

4. The display device of claim 1, further comprising:

a fourth control line;

wherein the pixel circuit further comprises:

a fourth transistor having a first terminal, a second terminal, and a control terminal, wherein the first terminal of the fourth transistor is coupled to the first control line, the second terminal of the fourth transistor is coupled to the first terminal of the second transistor, and the control terminal of the fourth transistor is coupled to the fourth control line.

5. The display device of claim 1, wherein:

during a first refreshing process:

at a first time point, a voltage of the common voltage line changes from a low polarity voltage to a high polarity voltage, the high polarity voltage is higher than the low polarity voltage;

at a second time point, a voltage of the third control line is changed from a low voltage to a first intermediate voltage;

between the first time point and the second time point, a voltage of the source line is changed from a reference voltage to the first intermediate voltage, at a third time point, a voltage of the first control line is changed from the reference voltage to a first gate push voltage;

between the second time point and the third time point, a voltage of the second control line is changed from a high voltage to the low voltage;

at a fourth time point, the voltage of the source line is changed from the first intermediate voltage to a first data voltage;

at the fifth time point, the voltage of the second control line is changed from the low voltage to the high voltage, the voltage of the third control line is changed from the first intermediate voltage to the low voltage, and the voltage of the source line is changed from the first data voltage to a second intermediate voltage; and between the fifth time point and a sixth time point, the voltage of the first control line is changed from the first gate push voltage to the reference voltage;

the first intermediate voltage is substantially equal to a fourth data voltage plus a difference between the low polarity voltage and the high polarity voltage;

the second intermediate voltage is substantially equal to a third data voltage plus the difference between the low polarity voltage and the high polarity voltage;

the high voltage is higher than the fourth data voltage, the fourth data voltage is higher than the third data voltage, the third data voltage is higher than the first data voltage, the first data voltage is higher than or equal to the reference voltage, and the reference voltage is higher than the low voltage; and the first gate push voltage is substantially equal to the first data voltage plus the two times a threshold voltage of the first transistor and minus the first intermediate voltage.

6. The display device of claim 5, wherein:

during a second refreshing process after the first refreshing process:

at the sixth time point, the voltage of the third control line is changed from the low voltage to the second intermediate voltage;

between the sixth time point and a seventh time point, the voltage of the second control line is changed from the high voltage to the low voltage;

at the seventh time point, the voltage of the first control line is changed from the reference voltage to a second gate push voltage;

at an eighth time point, the voltage of the source line is changed from the second intermediate voltage to a second data voltage;

at a ninth time point, the voltage of the second control line is changed from the low voltage to the high voltage, the voltage of the third control line is changed from the second intermediate voltage to the low voltage, and the voltage of the source line is changed from the second data voltage to a third intermediate voltage; and between the ninth time point and a tenth time point, the voltage of the first control line is changed from the second gate push voltage to the reference voltage;

the third intermediate voltage is substantially equal to the second data voltage plus the difference between the low polarity voltage and the high polarity voltage; and the second gate push voltage is substantially equal to the second data voltage plus the two times the threshold voltage and minus the second intermediate voltage.

7. The display device of claim 1, wherein:

during a first refreshing process:

at a first time point, a voltage of the common voltage line changes from a high polarity voltage to a low polarity voltage, the high polarity voltage is higher than the low polarity voltage;

at a second time point, a voltage of the source line is changed from a reference voltage to a prepare voltage;

at the second time point, a voltage of the third control line is changed from a low voltage to a first intermediate voltage;

at a third time point, a voltage of the first control line is changed from the reference voltage to a first gate push voltage;

between the third time point and a fourth time point, a voltage of the second control line is changed from a high voltage to the low voltage;

at the fourth time point, the voltage of the source line is changed from the prepare voltage to a fourth data voltage;

at a fifth time point, the voltage of the second control line is changed from the low voltage to the high voltage; and between the fifth time point and a sixth time point, the voltage of the first control line is changed from the first gate push voltage to the reference voltage;

the prepare voltage is higher than the fourth data voltage by at least one threshold voltage of the first transistor;

the first intermediate voltage is substantially equal to a first data voltage minus a difference between the high polarity voltage and the low polarity voltage;

the high voltage is higher than the fourth data voltage, the fourth data voltage is higher than the first data voltage, the first data voltage is higher than or equal to the reference voltage, the reference voltage is higher than the first intermediate voltage, and the first intermediate voltage is higher than the low voltage; and the first gate push voltage is equal to the fourth data voltage plus two times the threshold voltage and minus the first intermediate voltage.

8. The display device of claim 7, wherein:

during a second refreshing process after the first refreshing process:

at the sixth time point, the voltage of the third control line is changed from the first intermediate voltage to a second intermediate voltage;

at the seventh time point, the voltage of the first control line is changed from the reference voltage to a second gate push voltage;

between the seventh time point and an eighth time point, the voltage of the second control line is changed from the high voltage to the low voltage;

at the eighth time point, the voltage of the source line is changed from the fourth data voltage to a third data voltage;

at a ninth time point, the voltage of the second control line is changed from the low voltage to the high voltage; and between the ninth time point and a tenth time point, the voltage of the first control line is changed from the second gate push voltage to the reference voltage;

the second intermediate voltage is substantially equal to a second data voltage minus the difference between the high polarity voltage and the low polarity voltage;

the fourth data voltage is higher than the third data voltage, the third data voltage is higher than the second data voltage, the second data voltage is higher than the first data voltage;

the second gate push voltage is equal to the third data voltage plus two times the threshold voltage and minus the second intermediate voltage.

9. The display device of claim 1, wherein:

during a first refreshing process:

before a first time point, a voltage of the source line is changed from a reference voltage to a fourth data voltage;

at the first time point, a voltage of the third control line is changed from the low voltage to the fourth data voltage;

at a second time point, a voltage of the first control line is changed from the reference voltage to a gate push voltage, wherein the gate push voltage is higher than the reference voltage by two times a threshold voltage of the first transistor; and at a third time point, the voltage of the first control line is changed from the gate push voltage to the reference voltage;

a voltage of the second control line remains at a high voltage; and the high voltage is higher than the fourth data voltage, the fourth data voltage is higher than the reference voltage, and the reference voltage is higher than the low voltage.

10. The display device of claim 9, wherein:

during a second refreshing process after the first refreshing process:

at a fourth time point, the voltage of the third control line is changed from the fourth data voltage to a first data voltage;

between the fourth time point and a fifth time point, the voltage of the source line is changed from the fourth data voltage to a first data voltage;

at the fifth time point, the voltage of the first control line is changed from the reference voltage to the gate push voltage;

at a sixth time point, the voltage of the first control line is changed from the gate push voltage to the reference voltage; and at a seventh time point, the voltage of the third control line is changed from the first data voltage to the low voltage; and the fourth data voltage is higher than the first data voltage, and the first data voltage is higher than or equal to the reference voltage.

11. The display device of claim 9, wherein:

during a second refreshing process after the first refreshing process:

at a fourth time point, the voltage of the third control line is changed from the fourth data voltage to a third data voltage;

between the fourth time point and a fifth time point, the voltage of the source line is changed from the fourth data voltage to the third data voltage;

at the fifth time point, the voltage of the first control line is changed from the reference voltage to the gate push voltage; and at a sixth time point, the voltage of the first control line is changed from the gate push voltage to the reference voltage; and the fourth data voltage is higher than the third data voltage, and the third data voltage is higher than the reference voltage.

12. The display device of claim 1, wherein:

during a refreshing process:

before a first time point, a voltage of the source line is changed from a first data voltage to a second data voltage;

at the first time point, a voltage of the third control line is changed from a low voltage to the second data voltage;

between the first time point and a second time point, a voltage of the second control line is changed from a high voltage to the low voltage;

at the second time point, a voltage of the common voltage line is changed from the a high polarity voltage to a low polarity voltage;

at a third time point, a voltage of the first control line is changed from the first data voltage to a gate push voltage, wherein the gate push voltage is higher than the high voltage by a threshold voltage of the first transistor;

at a fourth time point, the voltage of the first control line is changed from the gate push voltage to a gate pull voltage, wherein the gate pull voltage is lower than the first data voltage by the second data voltage minus two times the threshold voltage of the first transistor;

at a fifth time point, the voltage of the source line is changed from the second data voltage to the first data voltage;

after the fifth time point, the voltage of the third control line is changed from the second data voltage to the low voltage, the voltage of the second control line is changed from the low voltage to the high voltage, and the voltage of the first control line is changed from the gate pull voltage to the first data voltage;

the high voltage is higher than the second data voltage, the second data voltage is higher than the first data voltage, and the first data voltage is higher than the low voltage.

13. The display device of claim 1, wherein:

during a refreshing process of the display device:

before a first time point, a voltage of the source line is changed from a first data voltage to a second data voltage;

at the first time point, a voltage of the third control line is changed from a low voltage to the second data voltage;

between the first time point and a second time point, a voltage of the second control line is changed from a high voltage to the low voltage;

at the second time point, a voltage of the common voltage line is changed from the a low polarity voltage to a high polarity voltage;

at a third time point, a voltage of the first control line is changed from the first data voltage to a gate push voltage, wherein the gate push voltage is higher than the high voltage by a threshold voltage of the third transistor;

at a fourth time point, the voltage of the first control line is changed from the gate push voltage to a gate pull voltage, wherein the gate pull voltage is lower than the first data voltage by the second data voltage minus two times the threshold voltage of the third transistor;

at a fifth time point, the voltage of the source line is changed from the second data voltage to the first data voltage;

after the fifth time point, the voltage of the third control line is changed from the second data voltage to the low voltage;

after the fifth time point, the voltage of the second control line is changed from the low voltage to the high voltage; and after the fifth time point, the voltage of the first control line is changed from the gate pull voltage to the first data voltage;

the high voltage is higher than the second data voltage, the second data voltage is higher than the first data voltage, and the first data voltage is higher than the low voltage.

14. A pixel circuit comprising:

a first capacitor having a first terminal and a second terminal, wherein the first terminal of the first capacitor is coupled to a common voltage line;

a second capacitor having a first terminal and a second terminal, wherein the first terminal of the second capacitor is coupled to a first control line;

a first transistor having a first terminal, a second terminal, and a control terminal, wherein the first terminal of the first transistor is directly coupled to a source line, the second terminal of the first transistor is coupled to the second terminal of the first capacitor, and the control terminal of the first transistor is coupled to the second terminal of the second capacitor;

a second transistor having a first terminal, a second terminal, and a control terminal, wherein the first terminal of the second transistor is coupled to the control terminal of the first transistor, and the control terminal of the second transistor is coupled to a second control line; and a third transistor having a first terminal, a second terminal, and a control terminal, wherein the first terminal of the third transistor is coupled to the second terminal of the second transistor, the second terminal of the third transistor is coupled to a third control line, and the control terminal of the third transistor is coupled to the second terminal of the first transistor.

15. The pixel circuit of claim 14, further comprising:

a fourth transistor having a first terminal, a second terminal, and a control terminal, wherein the first terminal of the fourth transistor is coupled to a first terminal of the first transistor, a second terminal coupled to the second terminal of the first transistor, and a control terminal coupled to a gate line.

16. The pixel circuit of claim 14, further comprising:

a fourth transistor having a first terminal, a second terminal, and a control terminal, wherein the first terminal of the fourth transistor is coupled to the source line, the second terminal of the fourth transistor is coupled to the first terminal of the second transistor, and the control terminal of the fourth transistor is coupled to a fourth control line.

17. The pixel circuit of claim 14, further comprising:

a fourth transistor having a first terminal, a second terminal, and a control terminal, wherein the first terminal of the fourth transistor is coupled to the first control line, the second terminal of the fourth transistor is coupled to the first terminal of the second transistor, and the control terminal of the fourth transistor is coupled to a fourth control line.

18. A display device, comprising:

a pixel array comprising:

a source line;

a common voltage line;

a first control line;

a second control line;

a third control line; and a pixel circuit comprising:

a first capacitor having a first terminal, and a second terminal, wherein the first terminal of the first capacitor is coupled to the common voltage line;

a second capacitor having a first terminal, and a second terminal, wherein the first terminal of the second capacitor is coupled to the first control line;

a first transistor having a first terminal, a second terminal, and a control terminal, wherein the first terminal of the first transistor is coupled to the source line, the second terminal of the first transistor is coupled to the second terminal of the first capacitor, and the control terminal of the first transistor is coupled to the second terminal of the second capacitor; and a second transistor having a first terminal, a second terminal, and a control terminal, wherein the first terminal of the second transistor is coupled to the control terminal of the first transistor, the second terminal of the second transistor is coupled to the second terminal of the first capacitor, and the control terminal of the second transistor is coupled to the second control line; and a third transistor having a first terminal, a second terminal, and a control terminal, wherein the first terminal of the third transistor is coupled to the second terminal of the second capacitor, and the control terminal of the third transistor is coupled to the third control line;

a source driver configured to drive the source line; and a control driver configured to drive the first control line, the second control line.

19. The display device of claim 18, wherein the second terminal of the third transistor is coupled to the source line.

20. The display device of claim 18, wherein the second terminal of the third transistor is coupled to the first control line.

* * * * *